US011827392B2

(12) United States Patent
Konstmann

(10) Patent No.: US 11,827,392 B2
(45) **Date of Patent: *Nov. 28, 2023**

(54) STRETCH-HOOD MACHINE

(71) Applicant: Signode Industrial Group LLC, Tampa, FL (US)

(72) Inventor: Tonny Konstmann, Nordborg (DK)

(73) Assignee: Signode Industrial Group LLC, Tampa, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/937,869

(22) Filed: Oct. 4, 2022

(65) Prior Publication Data

US 2023/0027796 A1 Jan. 26, 2023

Related U.S. Application Data

(63) Continuation of application No. 17/235,286, filed on Apr. 20, 2021, now Pat. No. 11,492,155.

(60) Provisional application No. 63/024,593, filed on May 14, 2020.

(51) Int. Cl.
*B65B 11/02* (2006.01)

(52) U.S. Cl.
CPC ..... *B65B 11/025* (2013.01); *B65B 2210/14* (2013.01)

(58) Field of Classification Search
CPC ..... B65B 9/135; B65B 9/14; B65B 11/025; B65B 2210/14
See application file for complete search history.

(56) References Cited

U.S. PATENT DOCUMENTS

| | | | |
|---|---|---|---|
| 3,902,303 | A | 9/1975 | King |
| 3,925,964 | A | 12/1975 | Birkenfeld et al. |
| 4,050,219 | A | 9/1977 | Higgins |
| 4,063,401 | A | 12/1977 | Higgins |
| 4,064,678 | A | 12/1977 | Grocke |
| 4,309,861 | A | 1/1982 | Karpisek |
| 4,473,990 | A | 10/1984 | Thimon |
| 4,724,658 | A | 2/1988 | Birkenfeld et al. |
| 5,247,783 | A | 9/1993 | Hannen |
| 5,259,170 | A | 11/1993 | Tolson |

(Continued)

FOREIGN PATENT DOCUMENTS

| | | | |
|---|---|---|---|
| CN | 101434299 | A | 5/2009 |
| CN | 101830292 | A | 9/2010 |

(Continued)

OTHER PUBLICATIONS

"International Search Report and Written Opinion", Issued by the European Patent Office as International Searching Authority for corresponding patent application No. PCT/US2021/029566 (12 pages), dated Jul. 16, 2021.

(Continued)

*Primary Examiner* — Thomas M Wittenschlaeger
(74) *Attorney, Agent, or Firm* — Neal, Gerber & Eisenberg LLP

(57) ABSTRACT

Various embodiments of the present disclosure provide a stretch-hood machine configured to optimize reefing device lateral movement and unwinding speed during film stretching to minimize reefing device travel distance and wear on the actuators that move the reefing devices and to reduce the possibility of damaging the film during stretching.

16 Claims, 15 Drawing Sheets

(56) References Cited

U.S. PATENT DOCUMENTS

| | | | | |
|---|---|---|---|---|
| 5,383,326 | A | 1/1995 | Dean et al. | |
| 5,595,042 | A * | 1/1997 | Cappi | B65B 11/54 53/64 |
| 5,603,198 | A * | 2/1997 | Rimondi | B65B 11/54 53/228 |
| 6,032,439 | A * | 3/2000 | Birkenfeld | B65B 9/135 53/567 |
| 6,470,654 | B1 | 10/2002 | Lachenmeier et al. | |
| 7,040,076 | B2 | 5/2006 | Lachenmeier et al. | |
| 7,975,456 | B2 * | 7/2011 | Lachenmeier | B65B 9/135 53/567 |
| 9,764,867 | B2 | 9/2017 | Lachenmeier et al. | |
| 10,421,570 | B2 * | 9/2019 | Kristensen | B65B 59/003 |
| 10,526,097 | B2 | 1/2020 | Lachenmeier et al. | |
| 10,538,354 | B2 | 1/2020 | Hannen et al. | |
| 10,696,506 | B2 | 6/2020 | Hannen et al. | |
| 11,492,155 | B2 * | 11/2022 | Konstmann | B65B 9/135 |
| 2011/0258973 | A1 | 10/2011 | Czok et al. | |
| 2014/0137516 | A1 * | 5/2014 | Lachenmeier | B65B 9/14 53/556 |
| 2018/0065766 | A1 | 3/2018 | Lachenmeier et al. | |
| 2019/0152632 | A1 * | 5/2019 | Lorenzen | B65B 9/135 |
| 2019/0248530 | A1 | 8/2019 | Fenn | |
| 2021/0188467 | A1 | 6/2021 | Bocedi et al. | |
| 2022/0185514 | A1 * | 6/2022 | Rapp | B65B 9/135 |

FOREIGN PATENT DOCUMENTS

| | | | |
|---|---|---|---|
| CN | 109153460 | A | 1/2019 |
| DE | 3921190 | A1 | 1/1991 |
| DE | 3941139 | A1 | 6/1991 |
| DE | 4103384 | A1 | 8/1991 |
| DE | 4307287 | C2 | 6/2001 |
| DE | 102015011766 | A1 | 3/2017 |
| EP | 0564971 | A2 | 10/1993 |
| EP | 1013549 | A1 | 6/2000 |
| EP | 1275582 | A1 | 1/2003 |
| EP | 1331168 | A1 | 7/2003 |
| EP | 1574432 | B1 | 5/2007 |
| EP | 3453626 | A1 | 3/2019 |
| EP | 3686111 | A1 | 7/2020 |
| ES | 2741879 | T3 | 2/2020 |
| FR | 2230549 | A1 | 12/1974 |
| WO | 03062062 | A1 | 7/2003 |
| WO | 2021058850 | A1 | 4/2021 |

OTHER PUBLICATIONS

"First Chinese Office Action and Search Report", from corresponding Chinese Patent Application No. 202180032821.1, dated Jun. 14, 2023.

* cited by examiner

STRETCH-HOOD MACHINE

PRIORITY

This continuation application claims priority to and the benefit of U.S. patent application Ser. No. 17/235,286, filed Apr. 20, 2021, which claims priority to and the benefit of U.S. Provisional Patent Application No. 63/024,593, filed May 14, 2020, the entire contents of both of which are incorporated herein by reference.

FIELD

The present disclosure relates to stretch-hood machines for wrapping loads of goods with tubular stretch film, and more particularly to stretch-hood machines configured to optimize reefing device lateral movement and unwinding speed during film stretching.

BACKGROUND

Stretch-hood machines wrap loads of goods with tubular plastic stretch film. These stretch-hood machines include a frame that supports a film-supply assembly, a film-opening assembly, and a reefing-and-wrapping assembly. The reefing-and-wrapping assembly includes a wrapping carriage that supports four reefing devices. Each reefing device includes a support that supports a drive roller and a vertically extending reefing finger. A motor drives the drive roller, and the reefing finger supports a freely rotatable guide roller. The drive roller is movable toward and away from the guide roller.

To wrap a load of goods, the film-supply assembly draws the tubular film from a film roll, cuts the film to a desired length to form a segment of tubular film, and in certain instances heat seals the top of the segment of tubular film closed. The film-opening assembly opens the bottom portion of the segment of tubular film so its perimeter is generally rectangular. Each reefing device moves laterally inwardly relative to the segment of tubular film (in the X- and Y-directions and generally parallel to the X-Y plane indicated in FIG. 1) to respective insertion positions in which they form an insertion configuration. The wrapping carriage then ascends relative to the segment of tubular film (in the Z-direction indicated in FIG. 1) until the reefing fingers of the reefing devices enter the open bottom portion of the segment of tubular film near its four corners. The reefing devices then move laterally outwardly (in the X- and Y-directions and generally parallel to the X-Y plane indicated in FIG. 1) to respective reefing positions in which they form a reefing configuration in preparation for reefing the segment of tubular film onto the reefing fingers. The drive rollers of the reefing devices move toward their respective guide rollers to engage the outer surface of the segment of tubular film and force the inner surface of the segment of tubular film against the guide rollers, thereby sandwiching the tubular film between the rollers. The motors drive their respective drive rollers in a reefing rotational direction to reef (or gather) the segment of tubular film onto the reefing fingers. FIG. 1 shows (in a simplified manner) the reefing devices $RD_1$, $RD_2$, $RD_3$, and $RD_4$ in the reefing configuration after the unstretched segment of tubular film is reefed onto the reefing fingers. The perimeter of the unstretched segment of tubular film is labeled $F_{UNSTRETCHED}$.

After reefing, the reefing devices each move laterally outwardly (in the X- and Y-directions and generally parallel to the X-Y plane indicated in FIG. 1) into respective wrapping positions in which they form a wrapping configuration. Because the film is elastic, it stretches during this movement. FIG. 1 shows the reefing devices $RD_1'$, $RD_2'$, $RD_3'$, and $RD_4'$ in the wrapping configuration along with the stretched segment of tubular film, the perimeter of which is labeled $F_{STRETCHED}$. The wrapping configuration is (and therefore the wrapping positions are) determined based on the size and shape of the load so the perimeter of the segment of tubular film is sized to circumscribe the load once the reefing devices reach the wrapping configuration. As the reefing devices move to their wrapping positions, their motors drive their drive rollers in an unreefing rotational direction opposite the reefing rotational direction at an unwinding speed to unreef some (but not all) of the film from the reefing fingers. This partial unreefing during stretching prevents overstretching the portions of the film that engage the reefing fingers, which reduces the likelihood of the film being damaged during wrapping.

After the reefing devices reach the wrapping configuration, the wrapping carriage descends relative to the load (in the Z-direction indicated in FIG. 1). During this descent the motors drive the drive rollers of the reefing devices in the unreefing rotational direction at an unreefing speed to unreef the remainder of the film from the reefing fingers. As this occurs, the film attempts to return to its unstretched size and shape and laterally contracts onto the load, which unitizes the load and/or secures the load to a pallet. This completes the wrapping process, and a conveyor conveys the load from the stretch-hood machine.

One of these known stretch-hood machines includes hydraulic actuators fed by constant-flow pumps to move the reefing devices laterally inwardly and outwardly between their respective reefing and wrapping positions. As explained above, after reefing the reefing devices move laterally outwardly to their respective wrapping positions to stretch the segment of tubular film. To do so, as shown in FIG. 1, each reefing device must move outwardly from the load L a distance X1 in the X-direction and a distance Y1 in the Y-direction. The shortest path between a reefing device's reefing position and wrapping position is the straight-line path $P_{OPTIMAL}$ shown in FIG. 1.

The use of constant-flow pumps for the hydraulic actuators means that the reefing devices move at the same fixed speed in the X- and Y-directions. When the distances X1 and Y1 are the same, a reefing device RD will begin moving simultaneously in the X- and Y-directions and will simultaneously stop moving in the X- and Y-directions after reaching the wrapping position. The reefing device RD will follow the path $P_{OPTIMAL}$ and move in a straight line from the reefing position directly to the wrapping position. This means that in this scenario the reefing device RD moves the minimum distance between the two positions.

But that's not the case when the distances X1 and Y1 are different, as they are in the example shown in FIG. 1 in which the distance X1 is greater than the distance Y1. In these instances, the reefing device RD will begin moving simultaneously in the X- and Y-directions until it moves the shorter of the distances (here, Y1). At that point it will stop moving in that direction (here, the Y-direction) and continue moving in the other direction (here, the X-direction) before finally reaching the wrapping position and stopping. This means that in this scenario the reefing device RD does not follow a straight line path from the reefing position to the wrapping position and therefore travels further to reach the wrapping position, which reduces efficiency and increases wear on the actuators that move the reefing devices. For instance, as shown in FIG. 1, the reefing devices RD follow a path $P_{ACTUAL}$ in which they simultaneously move in the X- and Y-directions over a first distance. At that point the reefing devices RD stop moving in the Y-direction since they have already moved the distance Y1 and continue moving a second distance in the X-direction to reach their wrapping positions. The distance a reefing device travels over this two-step path is more than the distance the reefing device would have traveled over an optimal straight-line path.

Another issue is that the unwinding speed is typically set for a given type of tubular film and not changed during operation of the stretch-hood machine, even as load sizes (and therefore wrapping configurations) or other parameters change. A less-than-optimal unwinding speed (e.g., too slow for the wrapping parameters) can result in overly thin film at the reefing fingers after stretching, which increases the likelihood of damaging the film during wrapping and providing a suboptimal final product.

SUMMARY

Various embodiments of the present disclosure provide a stretch-hood machine configured to optimize reefing device lateral movement and unwinding speed during film stretching to minimize reefing device travel distance and wear on the actuators that move the reefing devices and to reduce the possibility of damaging the film during stretching.

DETAILED DESCRIPTION

Figure 1:
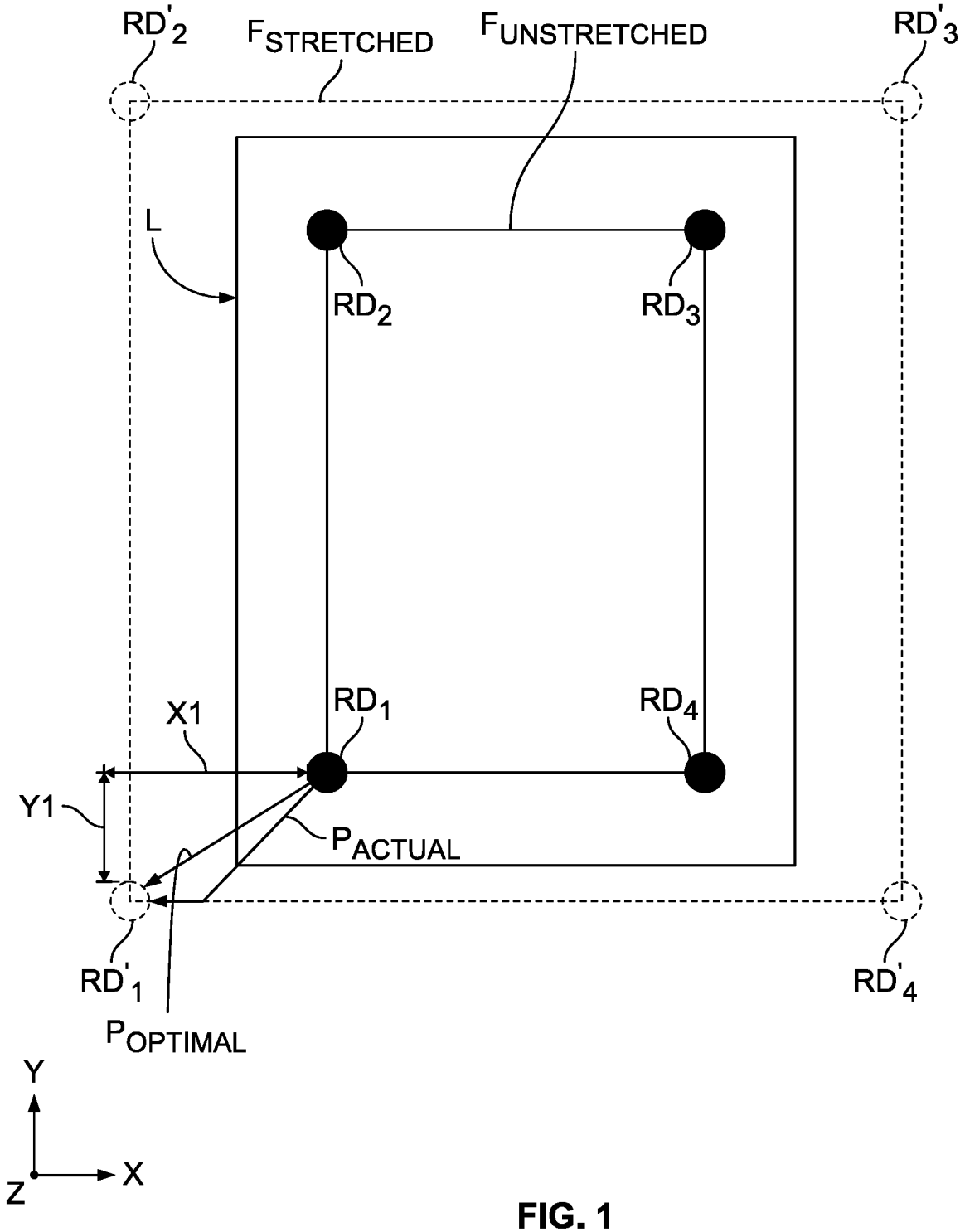
FIG. 1 (Prior Art)
FIG. 1 is a diagrammatic top plan view showing the reefing and wrapping positions of the reefing devices of a prior art stretch-hood machine along with the perimeter of a segment of tubular film in unstretched and stretched states.

While the systems, devices, and methods described herein may be embodied in various forms, the drawings show and the specification describes certain exemplary and non-limiting embodiments. Not all of the components shown in the drawings and described in the specification may be required, and certain implementations may include additional, different, or fewer components. Variations in the arrangement and type of the components; the shapes, sizes, and materials of the components; and the manners of connections of the components may be made without departing from the spirit or scope of the claims. Unless otherwise indicated, any directions referred to in the specification reflect the orientations of the components shown in the corresponding drawings and do not limit the scope of the present disclosure. Further, terms that refer to mounting methods, such as mounted, connected, etc., are not intended to be limited to direct mounting methods but should be interpreted broadly to include indirect and operably mounted, connected, and like mounting methods. This specification is intended to be taken as a whole and interpreted in accordance with the principles of the present disclosure and as understood by one of ordinary skill in the art.

Figure 2:
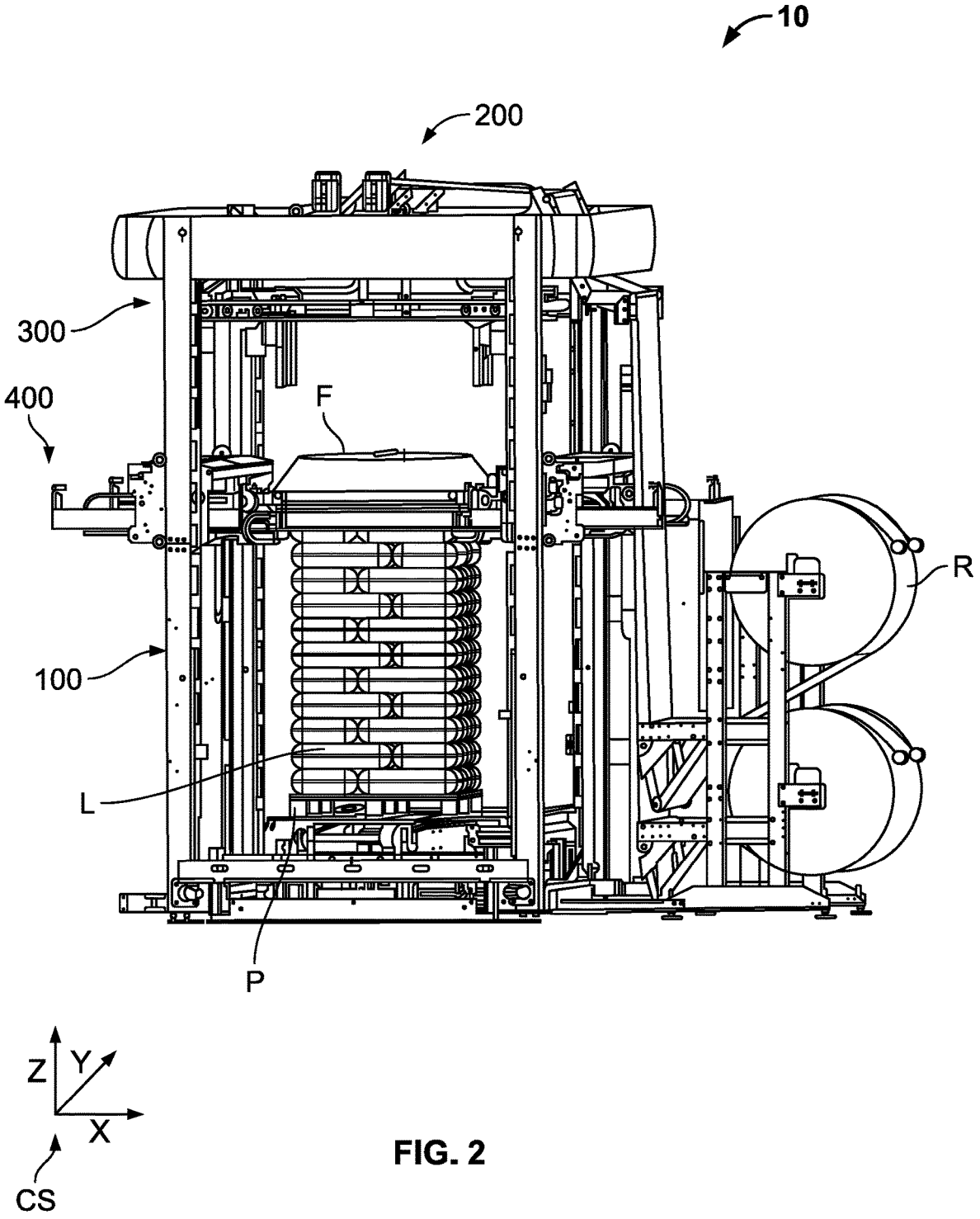
FIG. 2 is a perspective view of one embodiment of the stretch-hood machine of the present disclosure.
Figure 3:
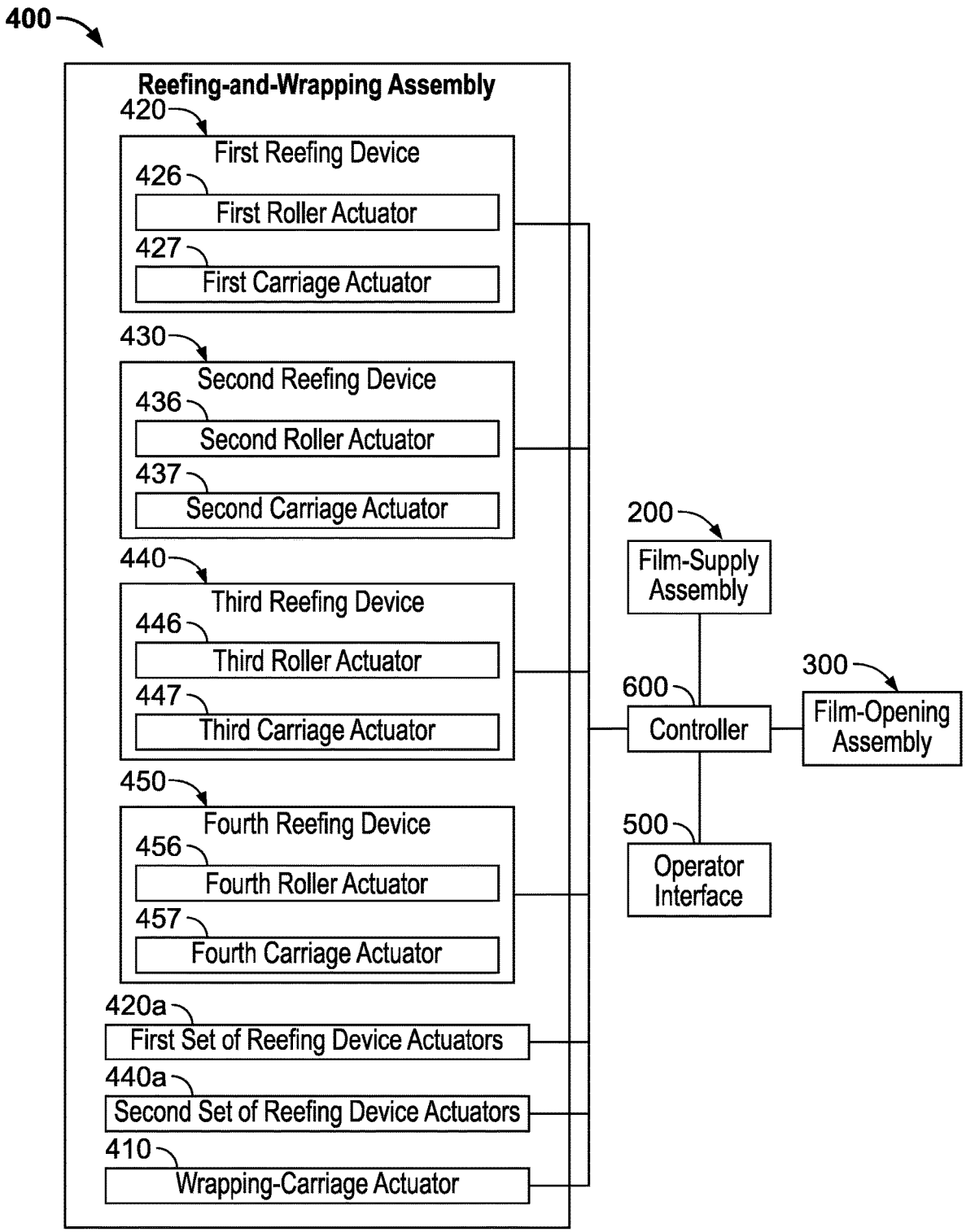
FIG. 3 is a block diagram showing certain components of the stretch-hood machine of FIG. 2.

Various embodiments of the present disclosure provide a stretch-hood machine configured to optimize reefing device lateral movement and unwinding speed during film stretching to minimize reefing device travel distance and wear on the actuators that move the reefing devices and to reduce the possibility of damaging the film during stretching. FIGS. 2-12 and 14A-14E show one embodiment of the stretch-hood machine 10 of the present disclosure and the assemblies and components of the stretch-hood machine 10. The stretch-hood machine 10 includes a machine frame 100, a film-supply assembly 200 supported by the machine frame 100, a film-opening assembly 300 supported by the machine frame 100, a reefing-and-wrapping assembly 400 supported by the machine frame 100, an operator interface 500, and a controller 600. A coordinate system CS (shown in FIG. 2) is used herein as a frame of reference for directional movement of various components of the stretch-hood machine 10 in the X-, Y-, and Z-directions (which are perpendicular to one another in this example embodiment).

The machine frame 100 is formed from multiple tubular and/or solid members and other elements (not individually labeled) and is configured to support the other assemblies and components of the stretch-hood machine 10. The machine frame 100 defines a wrapping area within its interior and has an infeed area (not labeled) at which a palletized load (such as a load L on a pallet P) is conveyed into the wrapping area for wrapping and an outfeed area (not labeled) at which the palletized load is conveyed from the wrapping area after wrapping. The illustrated machine frame 100 is merely one example configuration, and any suitable configuration may be employed.

The film-supply assembly 200 includes suitable components configured to form a segment of tubular film F that the stretch-hood machine 10 then uses to wrap the load L. More specifically, and as is known in the art, the film-supply assembly 200 includes components suitable to draw a length of tubular film from a roll R of tubular film rotatably mounted to the machine frame 100, cut the length of tubular film from the roll R to form the segment of tubular film F, and (in certain instances) close the upper end of the segment of tubular film (such as via a heat-sealing mechanism). The controller 600 determines the length of the segment of tubular film F based (in part) on the height of the load L, as is known in the art.

The film-opening assembly 300 includes suitable components configured to open a bottom portion of the segment of tubular film F so it forms a generally rectangular perimeter in preparation for reefing by the reefing-and-wrapping assembly 400. More specifically, and as is known in the art, the film-opening assembly 300 includes four suction boxes and four corresponding holding devices (not labeled) that are movable laterally inward and outward in the X- and Y-directions and generally parallel to the X-Y plane relative to the segment of tubular film F. To open the bottom portion of the segment of tubular film F, the suction boxes move laterally inward in the X- and Y-directions so they are positioned adjacent the outer surface of the bottom portion of the segment of tubular film F. A vacuum is generated to draw the bottom portion of the segment of tubular film F onto the suction boxes, thereby partially opening the bottom portion. The holding devices then clamp the segment of tubular film, and the suction boxes and holding devices move laterally outward in the X- and Y-directions and generally parallel to the X-Y plane to open the bottom portion of the segment of tubular film F in preparation for reefing. At this point, the perimeter of the bottom portion of the segment of tubular film F forms a generally rectangular shape in preparation for reefing. This is merely one example of the film-opening assembly 300, and other embodiments of the film-opening assembly 300 may include any other suitable components.

The reefing-and-wrapping assembly 400 includes a wrapping carriage (not shown for clarity); a wrapping-carriage actuator 410; first, second, third, and fourth reefing devices 420, 430, 440, and 450; and first and second sets of reefing-device actuators 420*a* and 440*a*. The wrapping carriage includes a suitable frame and is vertically movable relative to the machine frame 100 in the Z-direction between upper and lower positions. The wrapping-carriage actuator 410, which may include any suitable actuator (such as an electric or a hydraulic motor), is operably connected to the wrapping carriage to move the wrapping carriage between its upper and lower positions.

Figure 4:
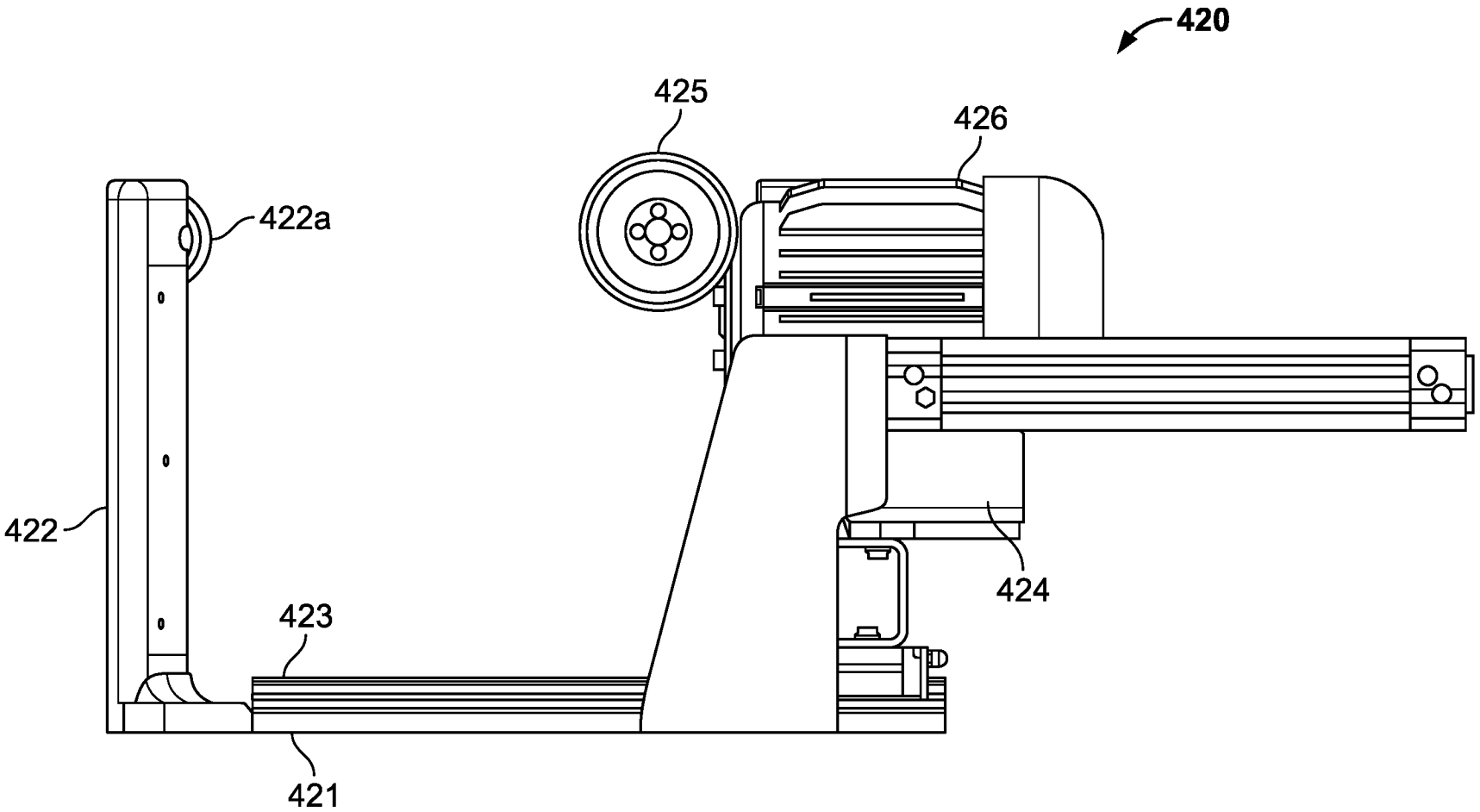
FIG. 4 is a side elevational view of one of the reefing devices of the stretch-hood machine of FIG. 2 with the reefing carriage in its home position.
Figure 9:
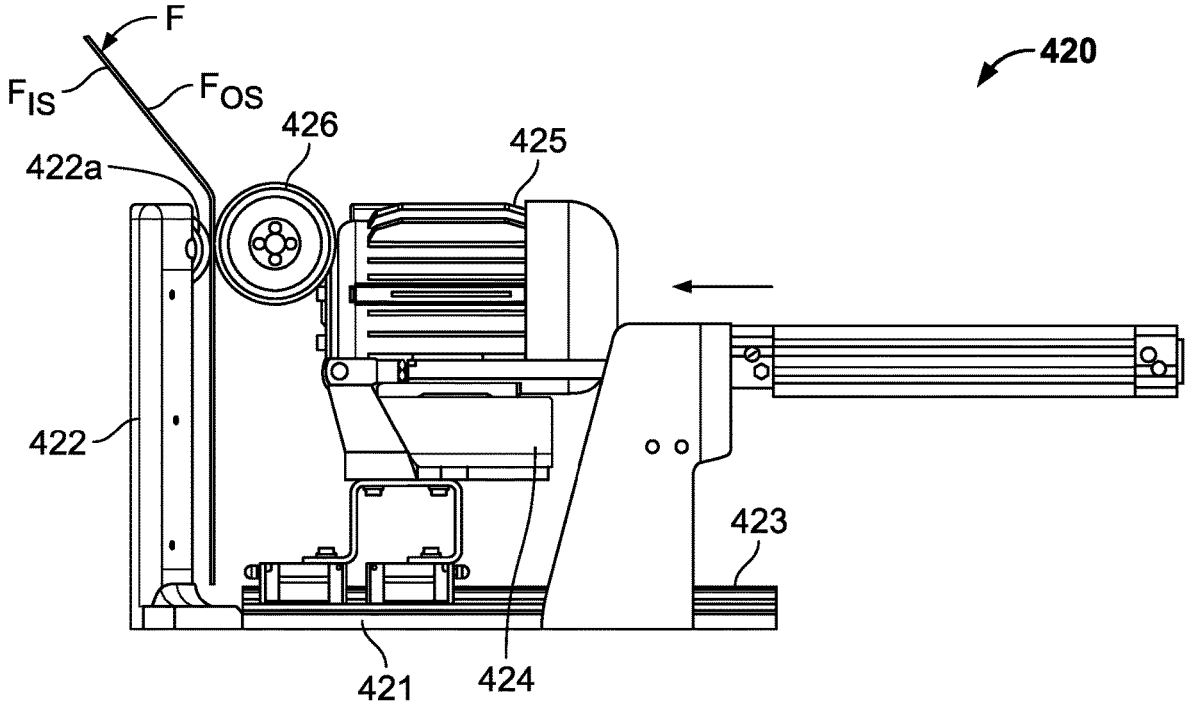
FIG. 9 is a side elevational view of the reefing device of FIG. 3 that corresponds to FIG. 7.
Figure 11:
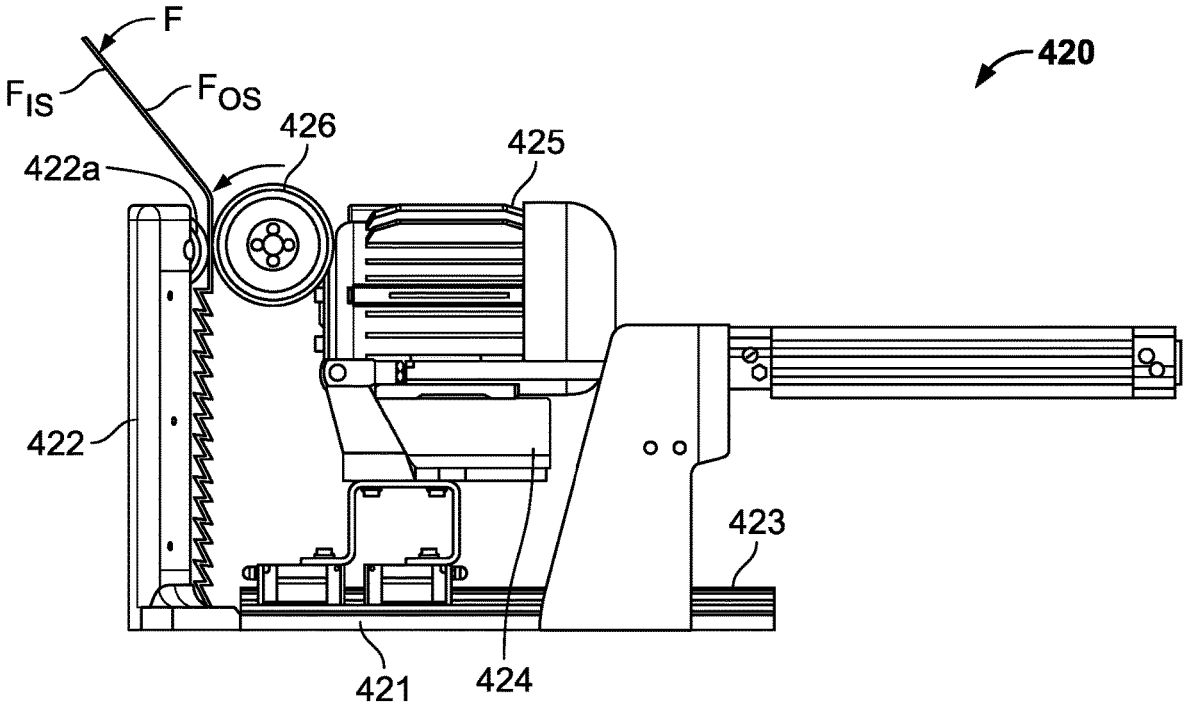
FIG. 11 is a side elevational view of the reefing device of FIG. 3 that corresponds to FIG. 10.

FIGS. 4, 9, and 11 show the first reefing device 420, which includes a first support 421, a first reefing finger 422 extending generally vertically in the Z-direction from one end of the first support 421, a freely rotatable first guide roller 422*a* mounted to the first reefing finger 422, a first rail 423 supported by the first support 421, a first carriage 424 mounted to the first rail 423 and configured to move along the first rail 423 between a home position spaced-apart from the first guide roller 422*a* (FIG. 4) and a reefing position adjacent the first guide roller 422*a* (FIGS. 9 and 11), a first drive roller 425 supported by the first carriage 424, a first roller actuator 426 supported by the first carriage 424 and operably connected to the first drive roller 425 to rotate the first drive roller 425 in opposing reefing and unreefing rotational directions, and a first carriage actuator 427 operably connected to the carriage 424 to move the carriage 424 between its home and reefing positions.

The second reefing device 430 is similar to the first reefing device 420 and not shown separately. The second reefing device includes a second support 431, a second reefing finger 432 extending generally vertically from one end of the second support 431, a freely rotatable second guide roller 432*a* mounted to the second reefing finger 432, a second rail 433 supported by the second support 431, a second carriage 434 mounted to the second rail 433 and configured to move along the second rail 433 between a home position spaced-apart from the second guide roller 432*a* and a reefing position adjacent the second guide roller 432*a*, a second drive roller 435 supported by the second carriage 434, a second roller actuator 436 supported by the second carriage 434 and operably connected to the second drive roller 435 to rotate the second drive roller 435 in opposing reefing and unreefing rotational directions, and a second carriage actuator 437 operably connected to the carriage 434 to move the carriage 434 between its home and reefing positions.

The third reefing device 440 is similar to the first reefing device 420 and not shown separately. The third reefing device includes a third support 441, a third reefing finger 442 extending generally vertically from one end of the third support 441, a freely rotatable third guide roller 442*a* mounted to the third reefing finger 442, a third rail 443 supported by the third support 441, a third carriage 444 mounted to the third rail 443 and configured to move along the third rail 443 between a home position spaced-apart from the third guide roller 442*a* and a reefing position adjacent the third guide roller 442*a*, a third drive roller 445 supported by the third carriage 444, a third roller actuator 446 supported by the third carriage 444 and operably connected to the third drive roller 445 to rotate the third drive roller 445 in opposing reefing and unreefing rotational directions, and a third carriage actuator 447 operably connected to the carriage 444 to move the carriage 444 between its home and reefing positions.

The fourth reefing device 450 is similar to the first reefing device 420 and not shown separately. The fourth reefing device includes a fourth support 451, a fourth reefing finger 452 extending generally vertically from one end of the fourth support 451, a freely rotatable fourth guide roller 452*a* mounted to the fourth reefing finger 452, a fourth rail 453 supported by the fourth support 451, a fourth carriage 454 mounted to the fourth rail 453 and configured to move along the fourth rail 453 between a home position spaced-apart from the fourth guide roller 452*a* and a reefing position adjacent the fourth guide roller 452*a*, a fourth drive roller 455 supported by the fourth carriage 454, a fourth roller actuator 456 supported by the fourth carriage 454 and operably connected to the fourth drive roller 455 to rotate the fourth drive roller 455 in opposing reefing and unreefing rotational directions, and a fourth carriage actuator 457 operably connected to the carriage 454 to move the carriage 454 between its home and reefing positions.

The first, second, third, and fourth reefing devices 420, 430, 440, and 450 are mounted to the frame of the wrapping carriage in a generally rectangular arrangement. The first set of reefing-device actuators 420*a* is operably connected to the first and second reefing devices 420 and 430 to move the first and second reefing devices 420 and 430 laterally inwardly and outwardly in the X- and Y-directions and generally parallel to the X-Y plane relative to the wrapping carriage (and the load L and the segment of tubular film F). The second set of reefing-device actuators 440*a* is operably connected to the third and fourth reefing devices 440 and 450 to move the third and fourth reefing devices 440 and 450 laterally inwardly and outwardly in the X- and Y-directions and generally parallel to the X-Y plane relative to the wrapping carriage (and the load L and the segment of tubular film F).

The first set of reefing-device actuators 420*a* includes a first X-actuator and a first Y-actuator that are controlled independently of one another. The first X-actuator is operably connected to the first and second reefing devices 420 and 430 and configured to move the first and second reefing devices 420 and 430 relative to the wrapping carriage in the X-direction. The first Y-actuator is operably connected to the first and second reefing devices 420 and 430 and configured to move the first and second reefing devices 420 and 430 relative to the wrapping carriage in the Y-direction. In this example embodiment, the first X- and Y-actuators include electric motors controlled by separate variable-frequency drives, but the actuators may be any suitable actuators in other embodiments (such as hydraulic motors controlled by proportional solenoid valves). In this example embodiment, the first X-actuator moves the first and second reefing devices simultaneously and at the same rate towards and away from the load in the X-direction. Similarly, the first Y-actuator moves the first and second reefing devices simultaneously and at the same rate towards and away from the load in the Y-direction.

The second set of reefing-device actuators 440*a* includes a second X-actuator and a second Y-actuator that are controlled independently of one another. The second X-actuator is operably connected to the third and fourth reefing devices 440 and 450 and configured to move the third and fourth reefing devices 440 and 450 relative to the wrapping carriage in the X-direction. The second Y-actuator is operably connected to the third and fourth reefing devices 440 and 450 and configured to move the third and fourth reefing devices 440 and 450 relative to the wrapping carriage in the Y-direction. In this example embodiment, the second X- and Y-actuators include electric motors controlled by separate variable-frequency drives, but the actuators may be any suitable actuators in other embodiments (such as hydraulic motors controlled by proportional solenoid valves). In this example embodiment, the second X-actuator moves the third and fourth reefing devices simultaneously and at the same rate towards and away from the load in the X-direction. Similarly, the second Y-actuator moves the third and fourth reefing devices simultaneously and at the same rate towards and away from the load in the Y-direction.

In other embodiments, the stretch-hood machine includes a separate set of one or more reefing device actuators for each individual reefing device. In some of these embodiments, each set of reefing device actuators includes independently controlled X- and Y-actuators similar to those described above.

The operator interface 500 is configured to receive inputs from an operator and, in certain embodiments, to output information to the operator. The operator interface includes one or more input devices configured to receive inputs from the operator. In various embodiments, the one or more input devices include one or more buttons (such as hard or soft keys), one or more switches, and/or a touch panel. In various embodiments, the operator interface 500 includes a display device configured to display information to the operator, such as information about the palletized load, the status of the wrapping operation, or the parameters of the stretch-hood machine 10. The operator interface may include other output devices instead of or in addition to the display device, such as one or more speakers and/or one or more lights. In certain embodiments, the operator interface 500 is formed as part of the stretch-hood machine 10 and is, for instance, mounted to the machine frame 100. In other embodiments, the operator interface is remote from the stretch-hood machine 10.

The controller 600 includes a processing device communicatively connected to a memory device. The processing device may include any suitable processing device such as, but not limited to, a general-purpose processor, a special-purpose processor, a digital-signal processor, one or more microprocessors, one or more microprocessors in association with a digital-signal processor core, one or more application-specific integrated circuits, one or more field-programmable gate array circuits, one or more integrated circuits, and/or a state machine. The memory device may include any suitable memory device such as, but not limited to, read-only memory, random-access memory, one or more digital registers, cache memory, one or more semiconductor memory devices, magnetic media such as integrated hard disks and/or removable memory, magneto-optical media, and/or optical media. The memory device stores instructions executable by the processing device to control operation of the stretch-hood machine 10 (such as to carry out the wrapping process described below).

The controller 600 is communicatively and operably connected to the film-supply assembly 200; the film-opening assembly 300; the wrapping-carriage actuator 410; the first and second sets of reefing-device actuators 420*a* and 440*a*; the first, second, third, and fourth sets of roller actuators 426, 436, 446, and 456; and the first, second, third, and fourth carriage actuators 427, 437, 447, and 457 to control operation of these components to carry out a wrapping process 1000, as described below. The controller 600 is communicatively connected to the operator interface 500 to: (1) receive signals from the operator interface 500 that represent inputs received by the operator interface 500; and (2) send signals to the operator interface 500 to cause the operator interface 500 to output (such as to display) information.

Figure 13:
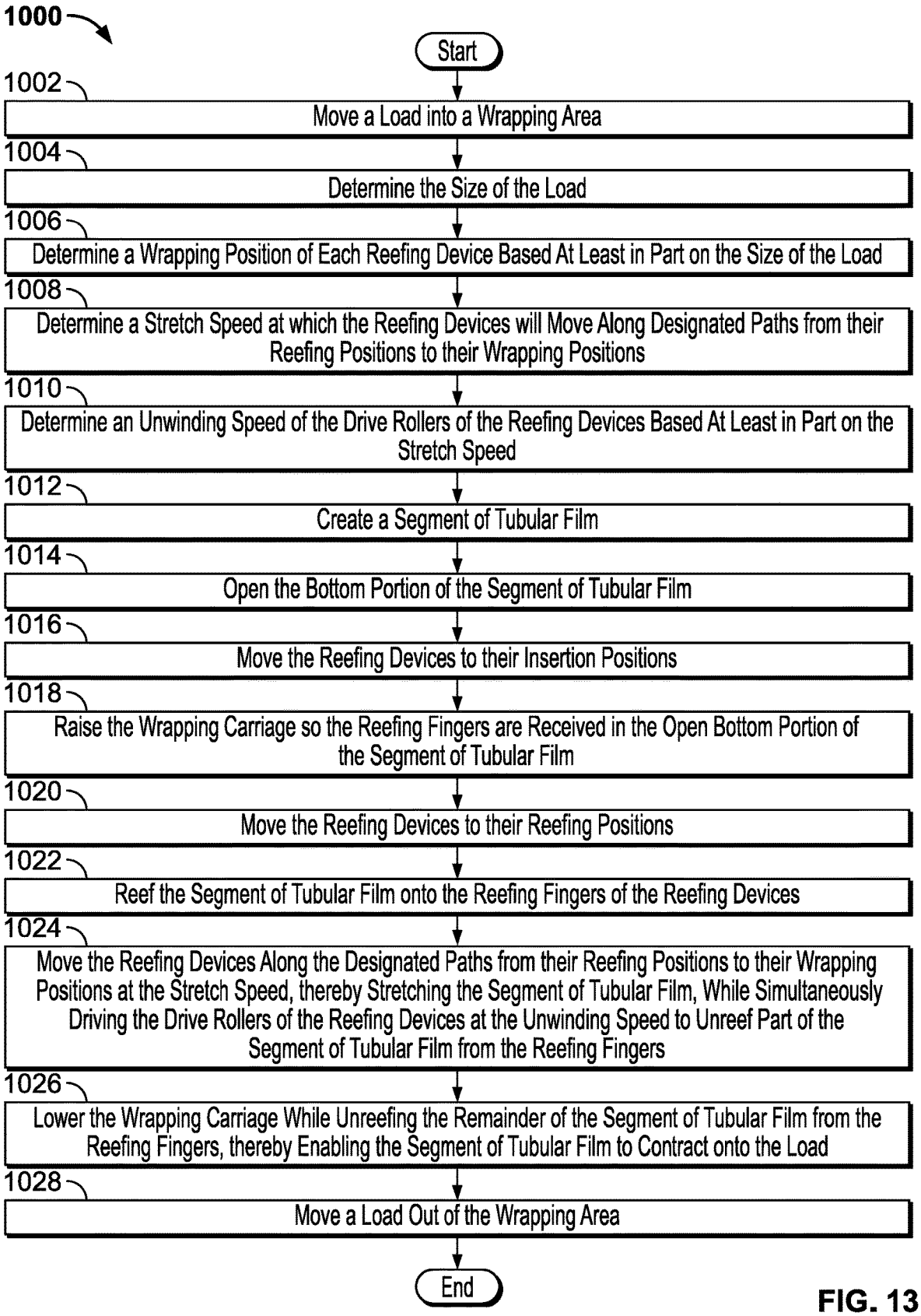
FIG. 13 is a flowchart of an example wrapping process of the present disclosure.

FIG. 13 is a flowchart of an example wrapping process 1000 of the present disclosure. An example of each step of the wrapping process 1000 is provided for the stretch-hood machine 10 described above and shown in the Figures.

Figure 14B:
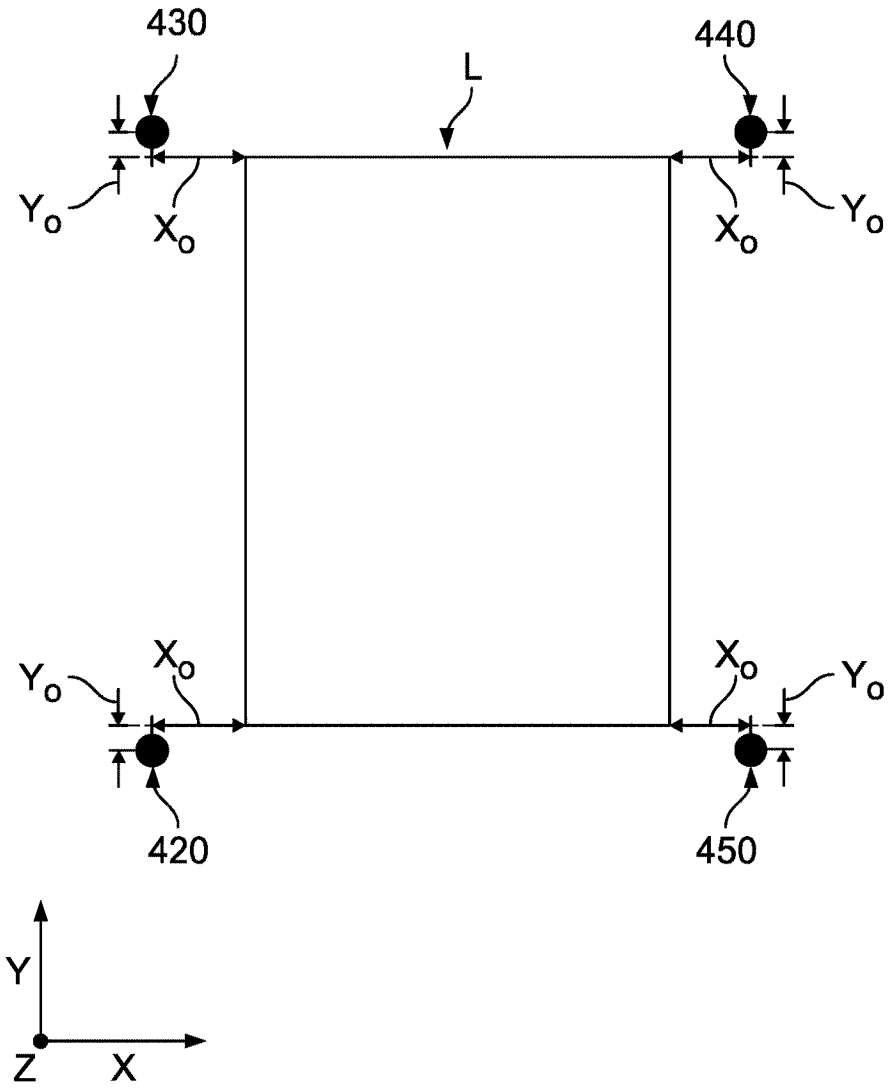
FIGS. 14A-14E are diagrammatic top plan views showing the reefing and wrapping positions of the reefing devices of the stretch-hood machine of FIG. 2 along with the perimeter of a segment of tubular film in unstretched and stretched states.
Figure 14A:
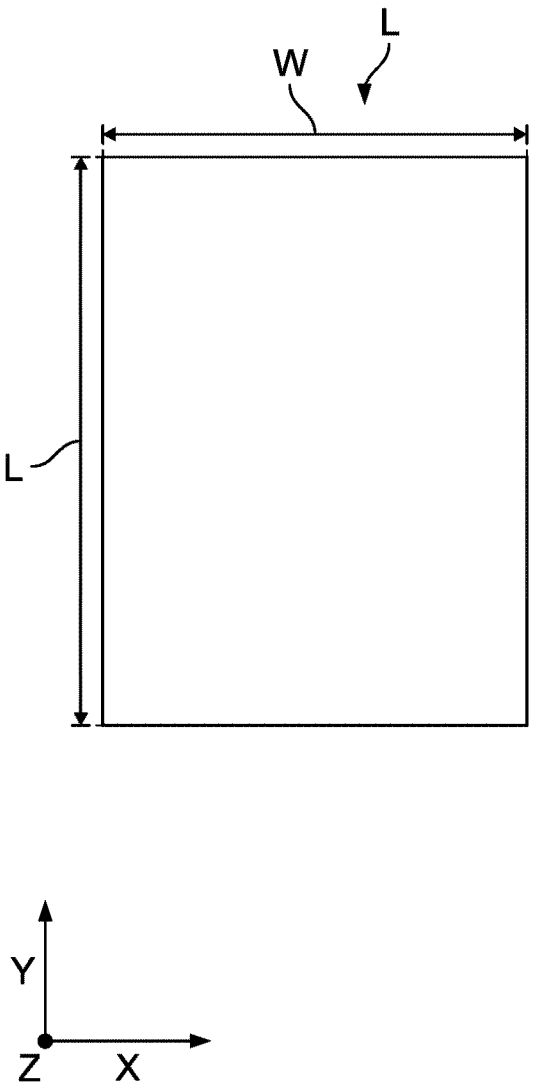

Upon initiation of the wrapping process 1000, a load is moved into a wrapping area of the stretch-hood machine, as block 1002 indicates. In this example embodiment, a conveyor moves the load L into the wrapping area of the machine frame 100 of the stretch-hood machine 10. The size of the load is determined, as block 1004 indicates. In this example embodiment, the operator inputs the size of the load L (here, length L and the width W of the load L as shown in FIG. 14A) using the operator interface 500, which then transmits the size of the load L to the controller 600. In other embodiments, the stretch-hood machine includes one or more sensors configured to detect the load and in doing so determine its size. In some embodiments, the stretch-hood machine receives the size of the load from another machine in a packaging line that includes the stretch-hood machine. These are a few examples, and the size of the load may be determined in any other suitable manner.

The wrapping positions of the reefing devices are then determined based at least in part on the size of the load, as block 1006 indicates. In this example embodiment, the controller 600 determines the wrapping positions of the reefing devices 420, 430, 440, and 450 based at least in part on the width W and the length L of the load L. More specifically, the controller 600 is configured to set the wrapping position of each reefing device using offsets $X_O$ in the X-direction and $Y_O$ in the Y-direction from the appropriate corner of the load, as shown in FIG. 14B. These offsets $X_O$ and $Y_O$ may be any suitable values and are received from the operator via the operator interface 500, though they may be determined in any other suitable manner in other embodiments (such as automatically by the controller based on the size of the load, the type of film, and/or any other suitable factors).

A stretch speed at which each reefing device will move along a designated path from their respective reefing positions to their respective wrapping positions is determined, as block 1008 indicates. The reefing positions are determined (such as preset by the operator) based on several factors, including the size of the film (e.g., its unstretched circumference). Since the shortest distance between two points is a straight line, in this example embodiment, the designated path between the reefing and wrapping positions for a given reefing finger is a straight line, which maximizes efficiency and minimizes wear on the reefing device actuators by avoiding extra unnecessary movement. In other embodiments, the designated path is not a straight-line path.

Figure 14C:
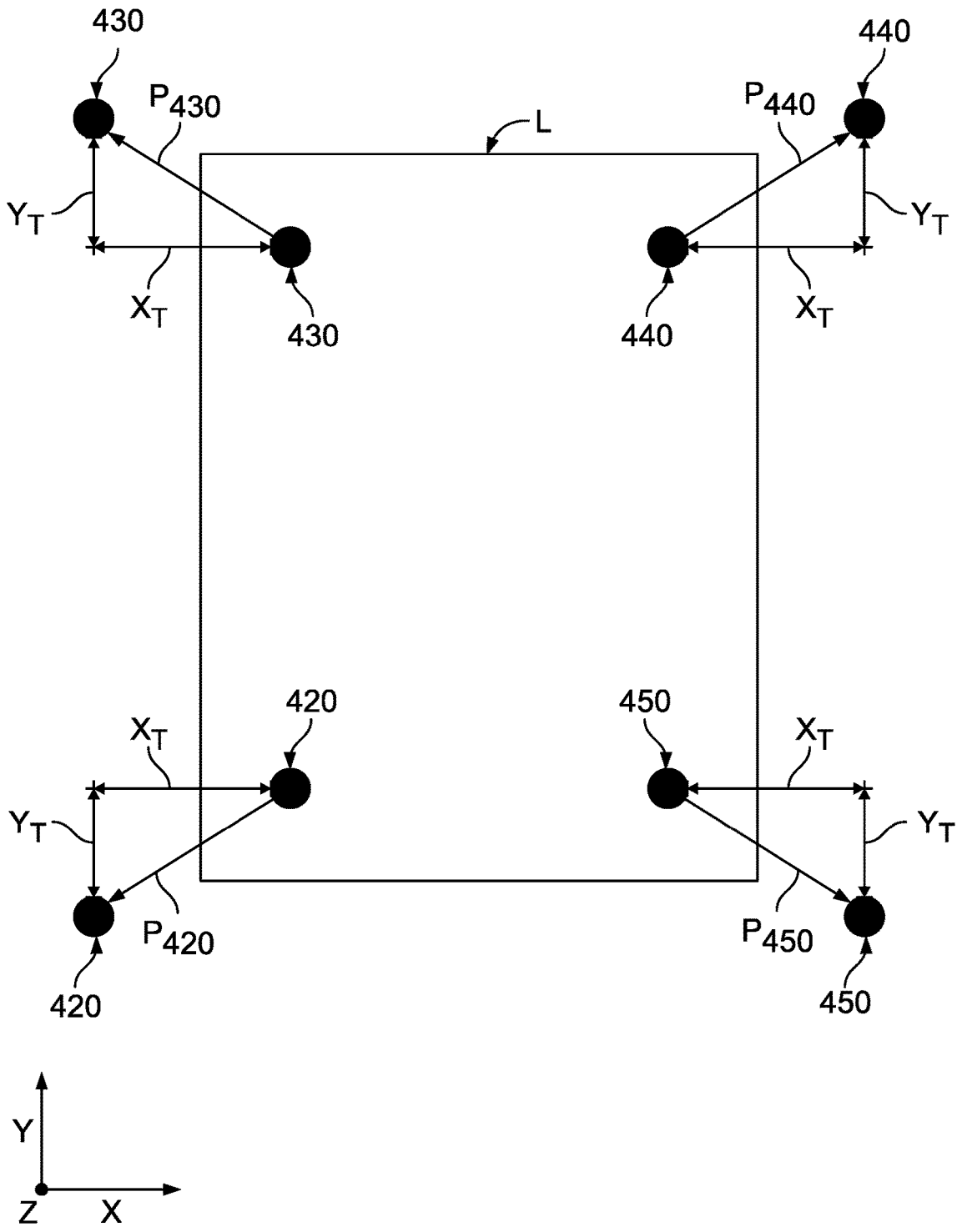

In this example embodiment and as shown in FIG. 14C, for each reefing device 420, 430, 440, and 450, a distance $X_T$ separates the respective reefing and wrapping positions in the X-direction, and a distance $Y_T$ separates the respective reefing and wrapping positions in the Y-direction. The controller 600 determines how to control the independent X- and Y-actuators of the first and second sets of reefing-device actuators 420*a* and 440*a* so the reefing devices 420, 430, 440, and 450 follow the designated (straight line) paths $P_{420}$, $P_{430}$, $P_{440}$, and $P_{450}$, respectively, from the respective reefing positions to the respective wrapping positions. If the distances between the reefing and wrapping positions are the same in the X- and Y-directions (i.e., if $X_T=Y_T$), the controller controls the X- and Y-actuators to move the reefing devices at the same lateral stretch speed in the X- and Y-directions so they follow the designated (straight line) paths. But if the distances are different, the controller controls one of the actuators to move the reefing devices slower in one direction than the other to ensure the reefing devices follow the designated (straight line) paths.

In this example embodiment, there is a designated lateral stretch speed at which the controller will, unless modified, control the X- and Y-actuators to move each reefing device in each of the X- and Y-directions. The designated lateral stretch speed may be present, input by the operator, or selected by the operator. If $X_T=Y_T$, the controller is configured to control the X- and Y-actuators to move the reefing devices at the designated lateral stretch speed in both the X- and Y-directions. But if $X_T>Y_T$ or $X_T<Y_T$, the controller is configured to use a lateral stretch speed that is lower than the designated lateral stretch speed for the shorter direction of travel to ensure the reefing devices move along the designated (straight line) paths. For instance, if $X_T>Y_T$, the controller is configured to control the X-actuators to move the reefing devices at the designated lateral stretch speed in the X-direction and to control the Y-actuators to move the reefing devices at a lateral stretch speed lower than the designated lateral stretch speed in the Y-direction. Accordingly, in this example embodiment the designated lateral stretch speed represents the maximum lateral stretch speed the reefing devices may move in the X- or Y-directions. In other embodiments, the controller is configured to move the reefing devices at the designated lateral stretch speed in the shorter direction of travel and at a lateral stretch speed higher than the designated lateral stretch speed in the longer direction of travel. Accordingly, in these embodiments, the designated lateral stretch speed represents the minimum lateral stretch speed the reefing device may move in the X- or Y-directions.

Once the controller 600 determines the lateral stretch speeds at which to move the reefing devices in the X- and Y-directions so the reefing devices follow the designated (straight line) paths, the controller 600 determines a resultant speed at which the reefing devices will move along the designated (straight line) paths based on the lateral stretch speeds at which the reefing devices will move in the X- and Y-directions. This resultant speed is the stretch speed of the reefing devices. When $X_T=Y_T$, the stretch speed is a designated stretch speed (since in this scenario the reefing devices move at the designated lateral stretch speed in the X- and Y-directions).

After the stretch speed of the reefing devices is determined, an unwinding speed of the drive rollers of the reefing devices is determined based at least in part on the stretch speed, as block 1010 indicates. In this example embodiment, the controller 600 determines the unwinding speed using a lookup table that correlates unwinding speed to stretch speed, via an algorithm that calculates an unwinding speed given a particular stretch speed, or in any other suitable manner. Generally, the unwinding speed increases as the stretch speed increases, because the faster the film stretches the faster the film should be partially unreefed to avoid excessive film thinning at the reefing fingers.

In this example embodiment, the controller 600 determines the unwinding speed based on a designated unwinding speed, the stretch speed, and the designated stretch speed. The designated unwinding speed represents a maximum unwinding speed in this example embodiment and may be present, input by the operator, or selected by the operator based on any of a variety of factors, such as load size, film size, film type, and the like. Specifically, in this example embodiment, the unwinding speed is equal to the designated unwinding speed multiplied by the ratio of the stretch speed to the designated stretch speed per the formula below. If the stretch speed is equal to the designated stretch speed (i.e., if $X_T=Y_T$ in this example embodiment), the unwinding speed is equal to the designated unwinding speed. But if the stretch speed is lower than the designated stretch speed, the unwinding speed is correspondingly lower than the designated unwinding speed.

$$\text{unwinding speed} = \text{designated unwinding speed} \times \left(\frac{\text{stretch speed}}{\text{designated stretch speed}}\right)$$

A segment of tubular film is then created, as block 1012 indicates. In this example embodiment, the controller 600 controls the film-supply assembly 200 to draw tubular film from the film roll R, cut the film to a desired length to form the segment of tubular film F, and heat seal the top of the segment of tubular film F closed. The bottom portion of the segment of tubular film is then opened, as block 1014 indicates. In this example embodiment, the controller 600 controls the film-opening assembly 300 (and more particularly, the suction boxes and holding devices) to open the bottom portion of the segment of tubular film F so its perimeter is generally rectangular, as explained above.

Figure 5:
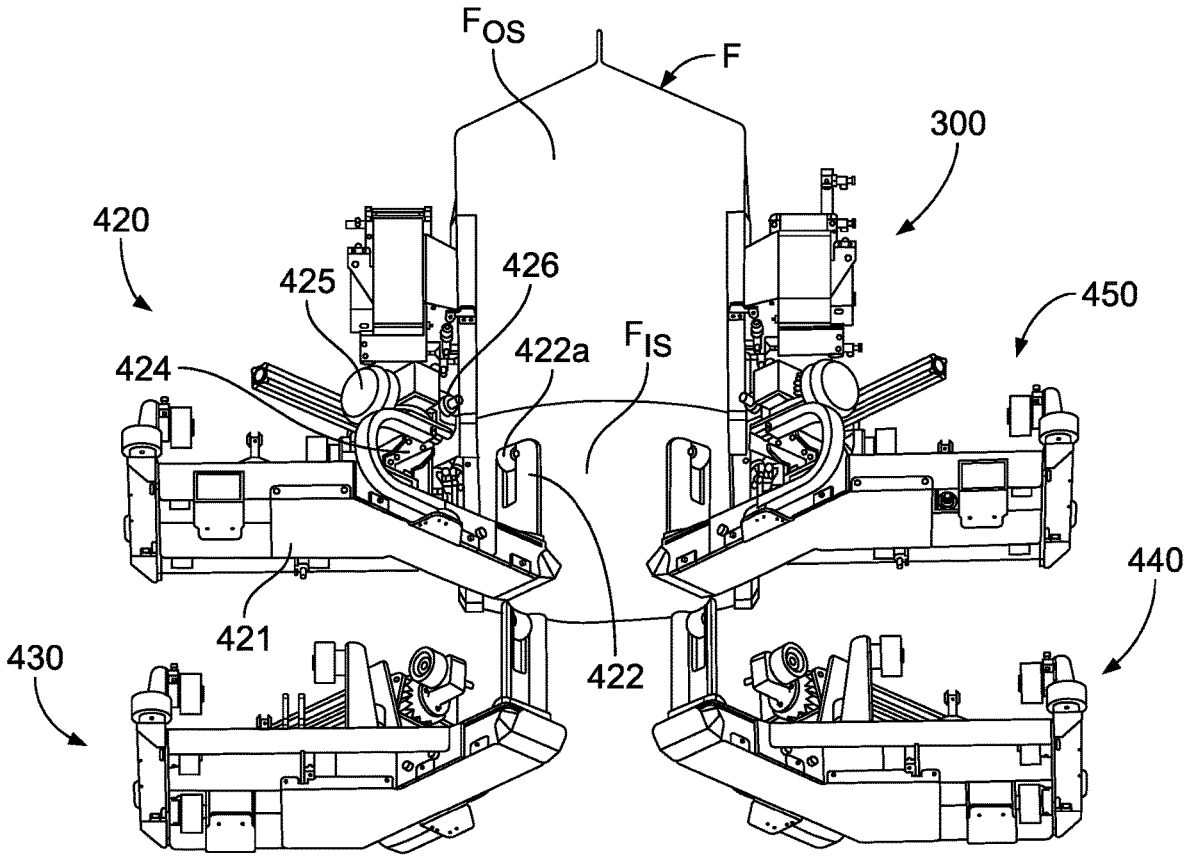
FIG. 5 is a perspective view of the film-opening device and the reefing devices of the stretch-hood machine of FIG. 2 after the film-opening device has opened the bottom of a segment of tubular film and before the reefing fingers of the reefing devices have been inserted into the bottom of the segment of tubular film.
Figure 6:
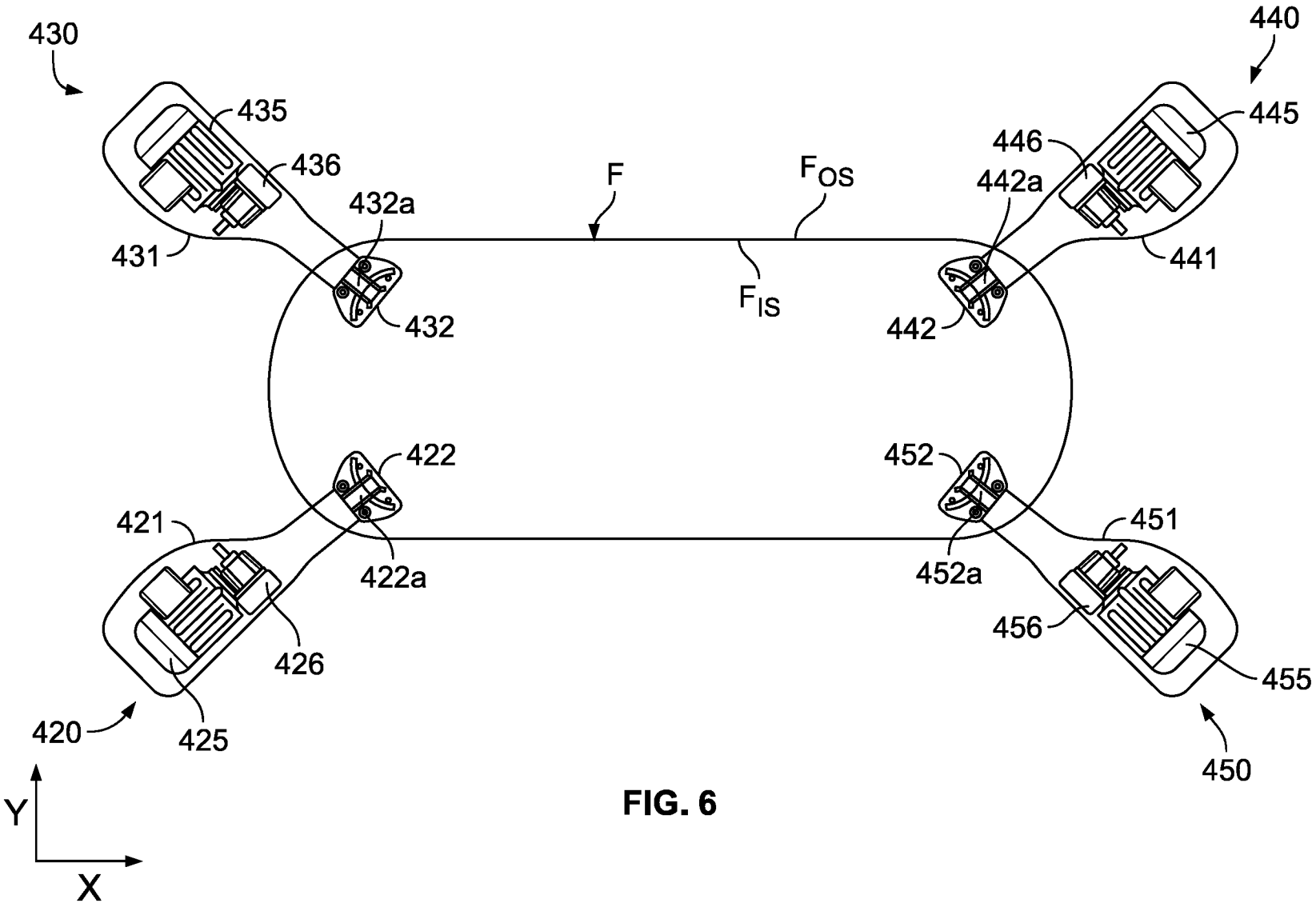
FIG. 6 is a simplified top plan view that corresponds to FIG. 5.

The reefing devices are then moved to their insertion positions, as block 1016 indicates. In this example embodiment, the controller 600 controls the first and second sets of reefing-device actuators 420*a* and 440*a* to move the respective reefing devices 420, 430, 440, and 450 laterally inwardly relative to the segment of tubular film F (in the X- and Y-directions and generally parallel to the X-Y plane) to their respective insertion positions in which they form an insertion configuration. FIGS. 5 and 6 show the reefing devices 420, 430, 440, and 450 at their insertion positions. The insertion positions are preset (such as by the operator) based on several factors, including the size of the film (e.g., its unstretched circumference). At this point, and as shown in FIG. 4 for the reefing device 420, the first, second, third, and fourth carriages 424, 434, 444, and 454 of the first, second, third, and fourth reefing devices 420, 430, 440, and 450 are in their respective home positions. The wrapping carriage is then raised so the reefing fingers of the reefing devices are received in the open bottom portion of the segment of tubular film, as block 1018 indicates. In this example embodiment, the controller 600 controls the wrapping-carriage actuator 410 to raise the wrapping carriage so the reefing fingers 422, 432, 442, and 452 of the respective reefing devices 420, 430, 440, and 450 are received in the open bottom portion of the segment of tubular film F.

Figure 7:
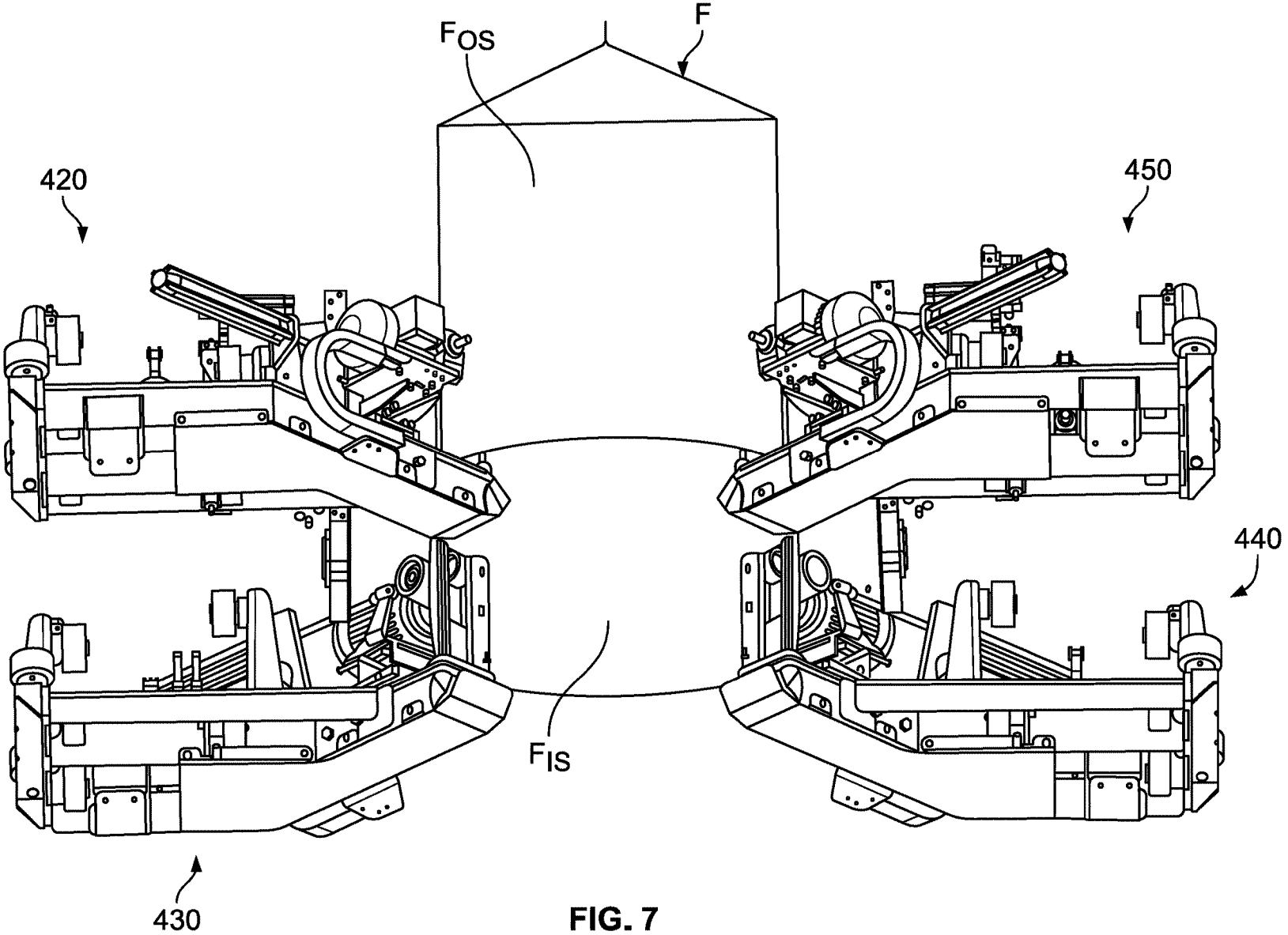
FIG. 7 is a perspective view similar to FIG. 5 but after the reefing fingers of the reefing devices have been inserted into the bottom of the segment of tubular film and after the reefing carriages of the reefing devices have moved to their respective reefing positions.
Figure 8:
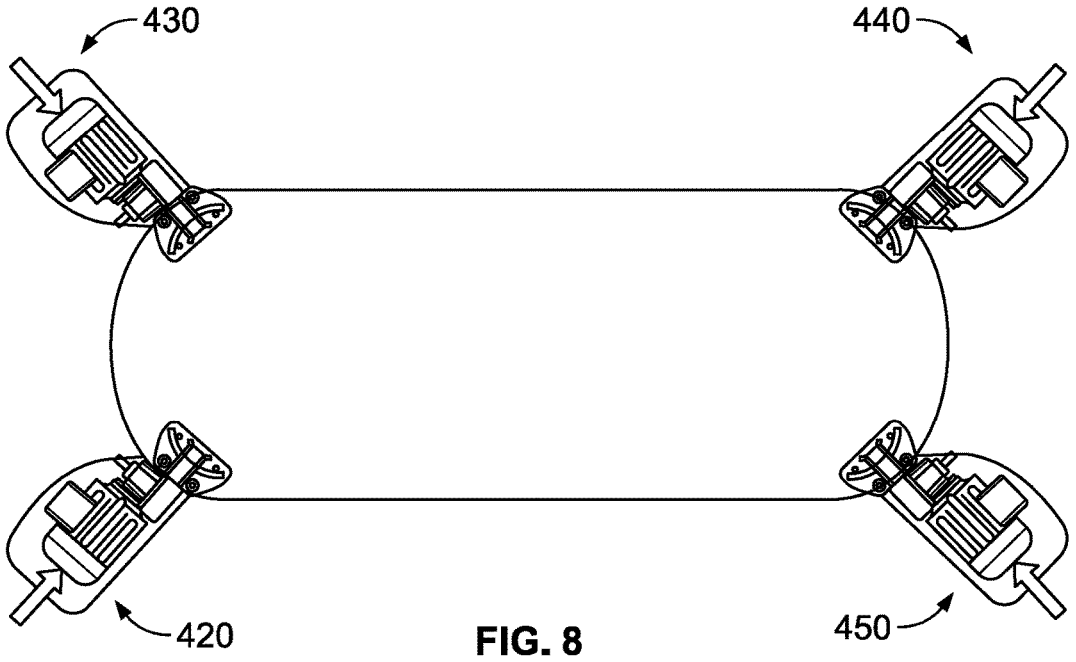
FIG. 8 is a simplified top plan view that corresponds to FIG. 7.
Figure 10:
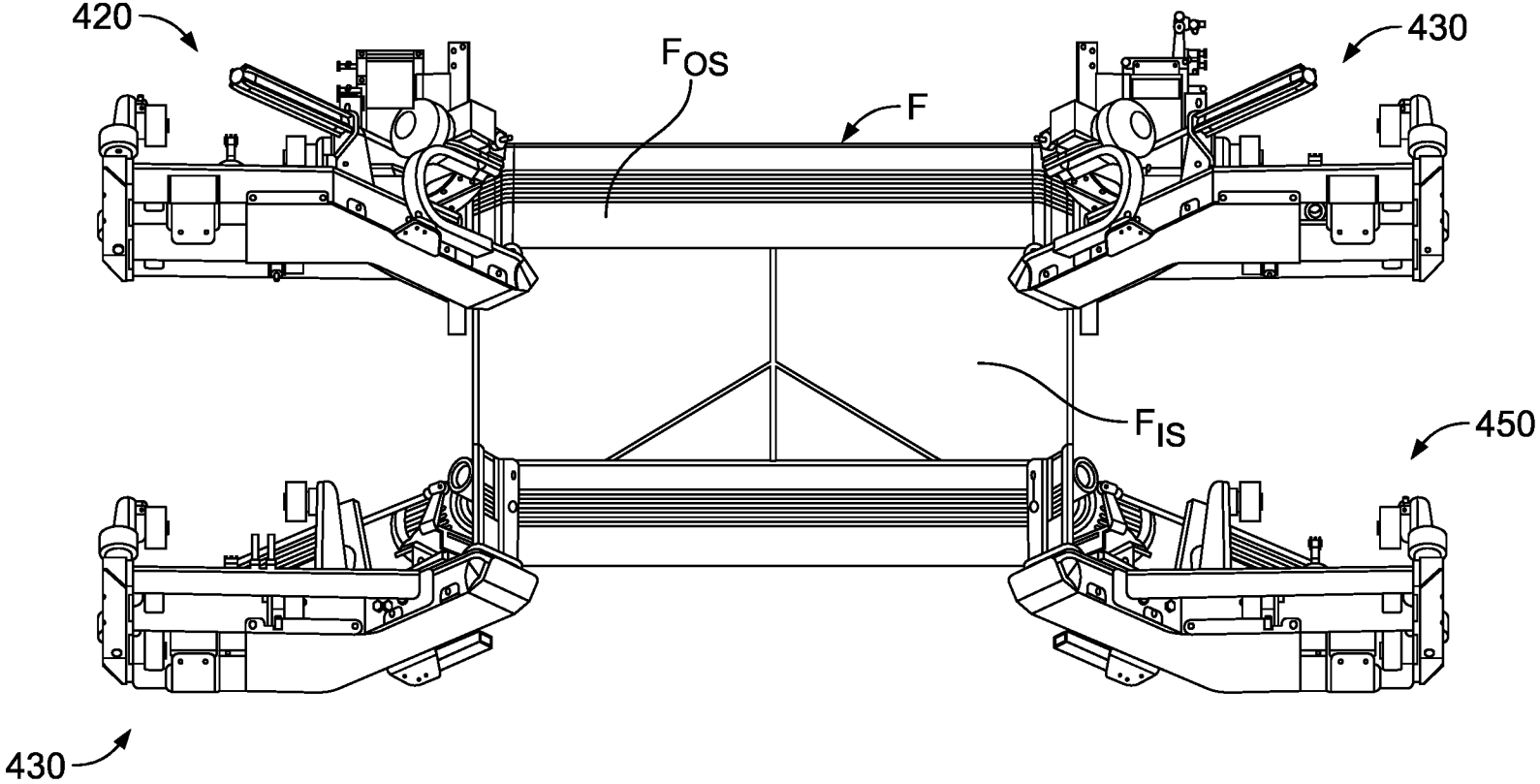
FIG. 10 is a perspective view similar to FIG. 5 but after the reefing devices have reefed the segment of tubular film onto their reefing fingers.
Figure 14E:
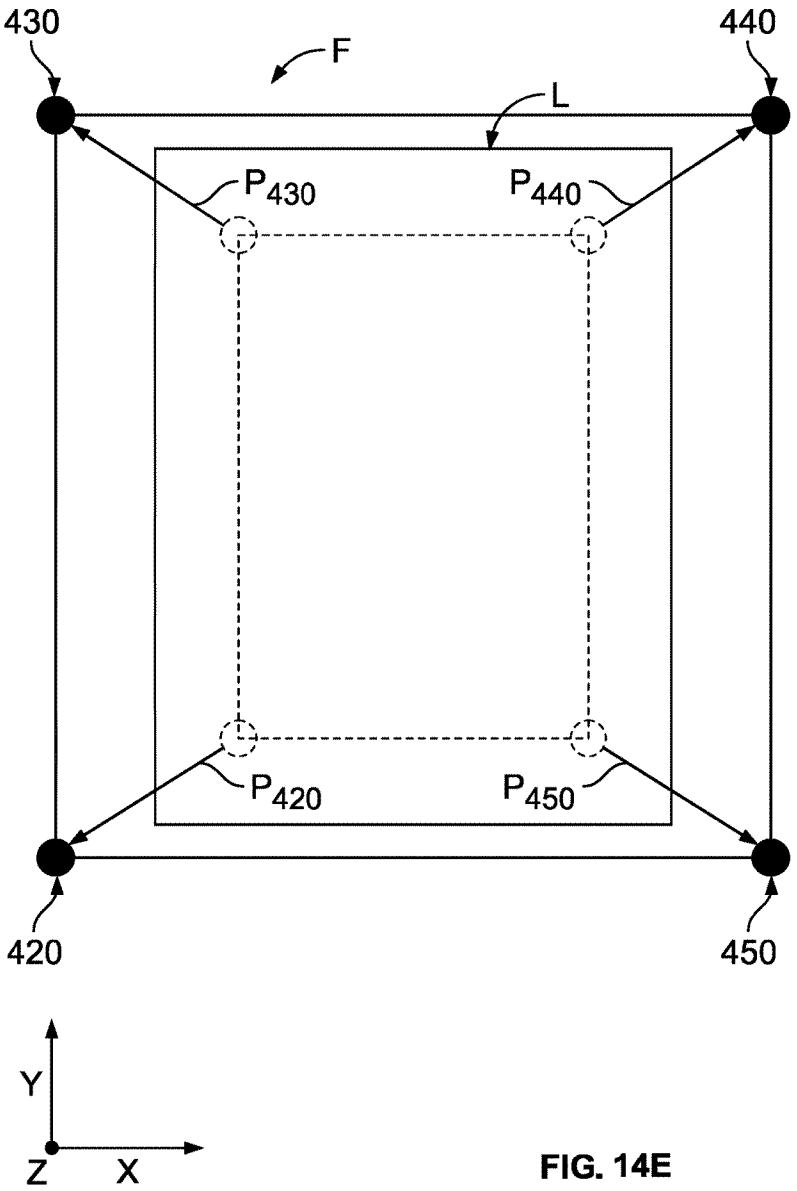
Figure 14D:
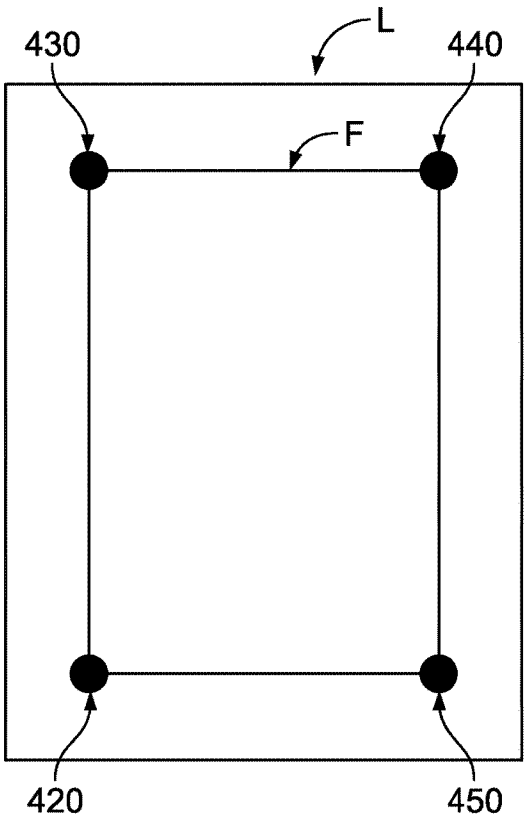

The reefing devices are then moved to their reefing positions, as block 1020 indicates. In this example embodiment, the controller 600 controls the first and second sets of reefing-device actuators 420*a* and 440*a* to move the respective reefing devices 420, 430, 440, and 450 laterally outwardly relative to the segment of tubular film F (in the X- and Y-directions and generally parallel to the X-Y plane) to their respective reefing positions in which they form a reefing configuration in preparation for reefing the segment of tubular film F. The reefing devices then reef the segment of tubular film onto the reefing fingers, as block 1022 indicates. In this example embodiment, the controller 600 controls the first, second, third, and fourth carriage actuators 427, 437, 447, and 457 to move the respective carriages 424, 434, 444, and 454 from their respective home positions to their respective reefing positions, which causes the drive wheels 425, 435, 445, and 455 of the reefing devices 420, 430, 440, and 450 to contact the inner surface FIN of the segment of tubular film F and force the outer surface $F_{OUT}$ of the segment of tubular film F against the respective guide wheels 422*a*, 432*a*, 442*a*, and 452*a*. FIGS. 7-9 show the reefing devices 420, 430, 440, and 450 in their reefing positions after their carriages have moved to their respective reefing positions. In certain embodiments, the carriages move to their reefing positions as the reefing devices move to their reefing positions. The controller 600 then controls the first, second, third, and fourth roller actuators 426, 436, 446, and 456 to drive the first, second, third, and fourth drive rollers 425, 435, 445, and 455 in a reefing rotational direction to reef the segment of tubular film F onto the reefing fingers 422, 432, 442, and 452. FIGS. 10 and 11 show the reefing devices 420, 430, 440, and 450 after reefing, and FIG. 14D shows reefing devices and the perimeter of the segment of tubular film F after reefing.

The reefing devices then move along their respective designated (straight line) paths from their respective reefing positions to their respective wrapping positions at the stretch speed, as block 1024 indicates. As this occurs, the drive rollers of the reefing devices are driven at the unwinding speed to unreef part of the segment of tubular film from the reefing devices, as block 1024 also indicates. The segment of tubular film stretches during this movement. In this example embodiment, the controller 600 controls the first and second sets of reefing-device actuators 420*a* and 440*a* to move the respective reefing devices 420, 430, 440, and 450 from their respective reefing positions to their respective wrapping positions along their respective designated (straight line) paths $P_{420}$, $P_{430}$, $P_{440}$, and $P_{450}$ at the stretch speed, as shown in FIG. 14E. This movement causes the segment of tubular film F to stretch. As this occurs, the controller 600 also controls the first, second, third, and fourth roller actuators 426, 436, 446, and 456 to drive the first, second, third, and fourth drive rollers 425, 435, 445, and 455 in an unreefing rotational direction opposite the reefing rotational direction and at the unwinding speed to unreef part of the segment of tubular film F from the reefing fingers 422, 432, 442, and 452. This partial unreefing during stretching reduces the likelihood of the film over-stretching at or near the reefing fingers.

Figure 12:
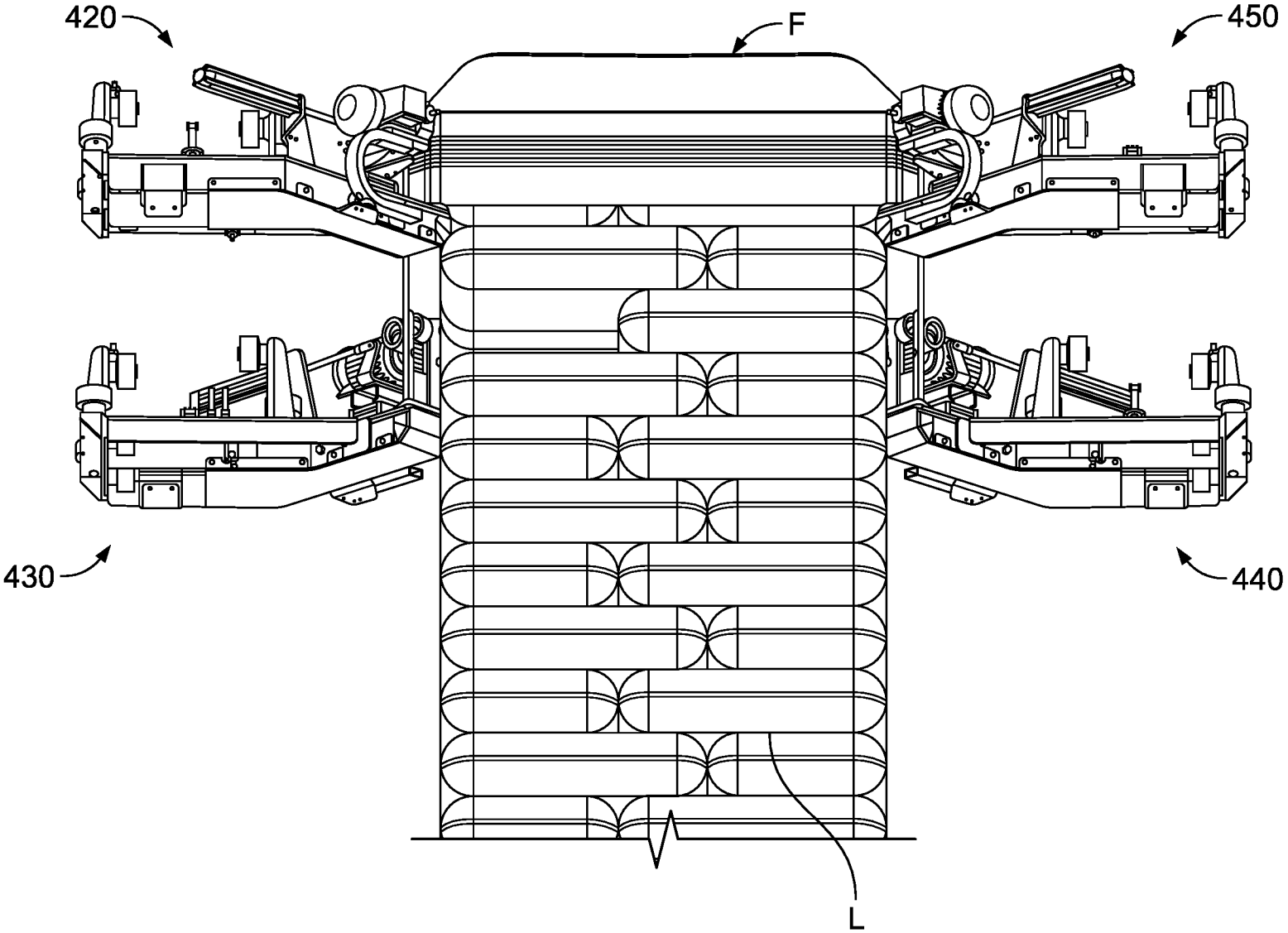
FIG. 12 is a perspective view similar to FIG. 5 but after the reefing devices have descended to just above the load in preparation for unreefing the segment of tubular film from the reefing fingers and onto the load.

The wrapping carriage then descends while the reefing devices unreef the remainder of the segment of tubular film from the reefing devices, as block 1026 indicates, which enables the segment of tubular film to contract onto the load. In this example embodiment, the controller 600 controls the wrapping-carriage actuator 410 to lower the wrapping carriage while controlling the first, second, third, and fourth roller actuators 426, 436, 446, and 456 to drive the first, second, third, and fourth drive rollers 425, 435, 445, and 455 in the unreefing rotational direction at an unreefing speed to unreef the remainder of the segment of tubular film F from the reefing fingers 422, 432, 442, and 452. FIG. 12 shows the reefing devices 420, 430, 440, and 450 just before unreefing the segment of tubular film F onto the load. As the segment of tubular film F is unreefed, it attempts to return to its unstretched size and shape and laterally contracts onto the load L, which unitizes the load and/or secures the load to a pallet. The wrapped load is then moved out of the wrapping area of the stretch-hood machine, as block 1028 indicates, thereby ending the wrapping process 1000. In this example embodiment, a conveyor moves the load L out of the wrapping area of the machine frame 100 of the stretch-hood machine 10.

The stretch-hood machine 10 and the corresponding wrapping process 1000 of the present disclosure provide multiple advantages over known stretch hood machines. First, the use of independently controlled X- and Y-actuators in each set of reefing-device actuators to move a given reefing device ensures that the reefing device can move on a straight line path from its reefing position to its wrapping position. This means that the reefing device takes the shortest path from the reefing position to the wrapping position, ensuring the reefing devices don't move further than necessary and reducing wear on the actuators. Second, determining the unwinding speed of the drive rollers during stretching based on the stretch speed optimizes the unwinding speed for the parameters of that specific wrapping process and ensures optimal stretching of the film at the reefing fingers.

It should be appreciated from the above that, in various embodiments, the present disclosure provides a stretch-hood machine comprising: a machine frame; a wrapping carriage movable relative to the machine frame between upper and lower positions; a wrapping-carriage actuator operably connected to the wrapping carriage to move the wrapping carriage between its upper and lower positions; a first reefing device supported by the wrapping-carriage actuator and comprising a first reefing finger, a first carriage, a first drive roller supported by the first carriage, a first roller actuator operably connected to the first drive roller to drive the first drive roller, and a first carriage actuator operably connected to the first carriage to move the first carriage relative to the first reefing finger; one or more first reefing-device actuators operably connected to the first reefing device and configured to move the first reefing device relative to the wrapping carriage between a first reefing position and a first wrapping position; and a controller configured to: determine a stretch speed based at least in part on a difference between the first reefing position and the first wrapping position; determine an unwinding speed based at least in part on the stretch speed; control the one or more first reefing-device actuators to move the first reefing device to the first reefing position; and after a segment of tubular film has been reefed onto the first reefing finger of the first reefing device: control the one or more first reefing-device actuators to move the first reefing device at the stretch speed from the first reefing position to the first wrapping position such that the first reefing device follows a first designated path and such that the segment of tubular film is stretched; and control the first roller actuator to drive the first drive roller at the unwinding speed in an unreefing direction while the first reefing device moves from the first reefing position to the first wrapping position to unreef part of the segment of tubular film from the first reefing finger of the first reefing device.

In various such embodiments of the stretch-hood machine, the unwinding speed increases as the stretch speed increases and decreases as the stretch speed decreases.

In various such embodiments of the stretch-hood machine, the first designated path comprises a straight line.

In various such embodiments of the stretch-hood machine, the controller is further configured to determine the first wrapping position based at least in part on a size of a load to-be-wrapped.

In various such embodiments of the stretch-hood machine, the controller is further configured to determine the first wrapping position by determining a first offset distance from the load in a first direction and a second offset distance from the load in a second direction.

In various such embodiments of the stretch-hood machine, the one or more first reefing-device actuators comprise: a first-direction actuator operably connected to the first reefing device and configured to move the first reefing device relative to the wrapping carriage in the first direction; and a second-direction actuator operably connected to the first reefing device and configured to move the first reefing device relative to the wrapping carriage in the second direction.

In various such embodiments of the stretch-hood machine, the first and second directions are perpendicular.

In various such embodiments of the stretch-hood machine, the first reefing and wrapping positions are separated by a first distance in the first direction and by a second distance in the second direction, wherein the controller is configured to control the one or more reefing device actuators to move the first reefing device at the stretch speed from the first reefing position to the first wrapping position by controlling the first-direction actuator to move the first reefing device in the first direction at a first lateral stretch speed and the second-direction actuator to move the first reefing device in the second direction at a second lateral stretch speed.

In various such embodiments of the stretch-hood machine, when the first and second distances are equal, the stretch speed is a designated stretch speed and the first and second lateral stretch speeds are the same designated lateral stretch speed.

In various such embodiments of the stretch-hood machine, when the first and second distances are different, the first and second lateral stretch speeds are different and the stretch speed is different from the designated stretch speed.

In various such embodiments of the stretch-hood machine, when the first distance is greater than the second distance, the first lateral stretch speed is the designated lateral stretch speed and the second lateral stretch speed is different from the designated lateral stretch speed.

In various such embodiments of the stretch-hood machine, the designated lateral stretch speed is received via operator input.

In various such embodiments of the stretch-hood machine, when the first distance is greater than the second distance, the second lateral stretch speed is lower than the designated lateral stretch speed.

In various such embodiments of the stretch-hood machine, the controller is configured to determine the unwinding speed based on the designated stretch speed, the stretch speed, and a designated unwinding speed.

In various such embodiments of the stretch-hood machine, the designated stretch speed and the designated unwinding speed are determined based on operator input.

In various such embodiments of the stretch-hood machine, the designated stretch speed is determined based on the designated lateral stretch speed, which is received via operator input.

In various such embodiments of the stretch-hood machine, the stretch-hood machine further comprises: a second reefing device supported by the wrapping-carriage actuator and comprising a second reefing finger, a second carriage, a second drive roller supported by the second carriage, a second roller actuator operably connected to the second drive roller to drive the second drive roller, and a second carriage actuator operably connected to the second carriage to move the second carriage relative to the second reefing finger, wherein the one or more first reefing-device actuators are operably connected to the second reefing device and configured to move the second reefing device relative to the wrapping carriage between a second reefing position and a second wrapping position; a third reefing device supported by the wrapping-carriage actuator and comprising a third reefing finger, a third carriage, a third drive roller supported by the third carriage, a third roller actuator operably connected to the third drive roller to drive the third drive roller, and a third carriage actuator operably connected to the third carriage to move the third carriage relative to the third reefing finger; a fourth reefing device supported by the wrapping-carriage actuator and comprising a fourth reefing finger, a fourth carriage, a fourth drive roller supported by the fourth carriage, a fourth roller actuator operably connected to the fourth drive roller to drive the fourth drive roller, and a fourth carriage actuator operably connected to the fourth carriage to move the fourth carriage relative to the fourth reefing finger; and one or more second reefing-device actuators operably connected to the third and fourth reefing devices and configured to move the third and fourth reefing devices relative to the wrapping carriage between third and fourth reefing position and third and fourth wrapping positions, respectively, wherein the controller is further configured to: control the first reefing-device actuators to move the second reefing device to the second reefing position and control the one or more second reefing-device actuators to move the third and fourth reefing devices to the respective third and fourth reefing positions; after the segment of tubular film has been reefed onto the first, second, third, and fourth reefing fingers of the respective first, second, third, and fourth reefing devices, control the one or more first reefing-device actuators to move the second reefing device at the stretch speed from the second reefing position to the second wrapping position such that the second reefing device follows a second designated path and control the one or more second reefing-device actuators to move the third and fourth reefing devices at the stretch speed from the third and fourth reefing positions to the third and fourth wrapping positions, respectively, such that the third and fourth reefing devices follow third and fourth designated paths, respectively, such that the segment of tubular film is stretched; and control the second, third, and fourth roller actuators to drive the respective second, third, and fourth drive rollers at the unwinding speed in the unreefing direction while second, third, and fourth reefing devices move from the second, third, and fourth reefing positions to the respective second, third, and fourth wrapping positions to unreef part of the segment of tubular film from the second, third, and fourth reefing fingers of the second, third, and fourth reefing devices.

In various such embodiments of the stretch-hood machine, the first, second, third, and fourth designated paths each comprise different straight lines.

It should further be appreciated from the above that, in various embodiments, the present disclosure provides a method of operating a stretch-hood machine, the method comprising: determining a stretch speed based at least in part on a difference between a first reefing position for a first reefing device and a first wrapping position for the first reefing device; determining an unwinding speed based at least in part on the stretch speed; moving the first reefing device to the first reefing position; reefing a segment of tubular film onto a first reefing finger of the first reefing device; and after the segment of tubular film has been reefed onto the first reefing finger of the first reefing device: moving the first reefing device at the stretch speed from the first reefing position to the first wrapping position such that the first reefing device follows a first designated path and such that the segment of tubular film is stretched; and driving a first drive roller of the first reefing device at the unwinding speed in an unreefing direction while the first reefing device moves from the first reefing position to the first wrapping position to unreef part of the segment of tubular film from the first reefing finger of the first reefing device.

In various such embodiments of the method, the unwinding speed increases as the stretch speed increases and decreases as the stretch speed decreases.

In various such embodiments of the method, the first designated path comprises a straight line.

In various such embodiments of the method, the method further comprises determining the first wrapping position based at least in part on a size of a load to-be-wrapped.

In various such embodiments of the method, the method further comprises determining the first wrapping position by determining a first offset distance from the load in a first direction and a second offset distance from the load in a second direction.

In various such embodiments of the method, wherein the first reefing and wrapping positions are separated by a first distance in the first direction and by a second distance in the second direction, the method further comprises moving the first reefing device at the stretch speed from the first reefing position to the first wrapping position by controlling a first-direction actuator to move the first reefing device in the first direction at a first lateral stretch speed and controlling the second-direction actuator to move the first reefing device in the second direction at a second lateral stretch speed.

In various such embodiments of the method, when the first and second distances are equal, the stretch speed is a designated stretch speed and the first and second lateral stretch speeds are the same designated lateral stretch speed.

In various such embodiments of the method, when the first and second distances are different, the first and second lateral stretch speeds are different and the stretch speed is different from the designated stretch speed.

In various such embodiments of the method, when the first distance is greater than the second distance, the first lateral stretch speed is the designated lateral stretch speed and the second lateral stretch speed is different from the designated lateral stretch speed.

In various such embodiments of the method, the designated lateral stretch speed is received via operator input.

In various such embodiments of the method, when the first distance is greater than the second distance, the second lateral stretch speed is lower than the designated lateral stretch speed.

In various such embodiments of the method, the method further comprises determining the unwinding speed based on the designated stretch speed, the stretch speed, and a designated unwinding speed.

In various such embodiments of the method, the method further comprises determining the designated stretch speed and the designated unwinding speed based on operator input.

In various such embodiments of the method, the method further comprises determining the designated stretch speed based on the designated lateral stretch speed, which is received via operator input.

In various such embodiments of the method, the method further comprises moving second, third, and fourth reefing devices to respective second, third, and fourth reefing positions; reefing the segment of tubular film onto second, third, and fourth reefing fingers of the respective second, third, and fourth reefing devices; after the segment of tubular film has been reefed onto the first, second, third, and fourth reefing fingers of the respective first, second, third, and fourth reefing devices, moving the second, third, and fourth reefing devices at the stretch speed from the second, third, and fourth reefing positions to the respective second, third, and fourth wrapping positions such that the second, third, and fourth reefing devices follow second, third, and fourth designated paths, respectively, such that the segment of tubular film is stretched; and driving second, third, and fourth drive rollers of the respective second, third, and fourth reefing devices at the unwinding speed in the unreefing direction while the second, third, and fourth reefing devices move from the second, third, and fourth reefing positions to the respective second, third, and fourth wrapping positions to unreef part of the segment of tubular film from the second, third, and fourth reefing fingers of the second, third, and fourth reefing devices.

In various such embodiments of the method, the first, second, third, and fourth designated paths each comprise different straight lines.

The invention claimed is:

1. A method of operating a stretch-hood machine, the method comprising:

determining a stretch speed based at least in part on a difference between a first reefing position for a first reefing device and a first wrapping position for the first reefing device;

determining an unwinding speed based at least in part on the stretch speed;

moving the first reefing device to the first reefing position;

reefing a segment of tubular film onto a first reefing finger of the first reefing device; and after the segment of tubular film has been reefed onto the first reefing finger of the first reefing device:

moving the first reefing device at the stretch speed from the first reefing position to the first wrapping position such that the first reefing device follows a first designated path and such that the segment of tubular film is stretched; and driving a first drive roller of the first reefing device at the unwinding speed in an unreefing direction while the first reefing device moves from the first reefing position to the first wrapping position to unreef part of the segment of tubular film from the first reefing finger of the first reefing device.

2. The method of claim 1, wherein the unwinding speed increases as the stretch speed increases and decreases as the stretch speed decreases.

3. The method of claim 1, wherein the first designated path comprises a straight line.

4. The method of claim 1, further comprising determining the first wrapping position based at least in part on a size of a load to-be-wrapped.

5. The method of claim 4, further comprising determining the first wrapping position by determining a first offset distance from the load in a first direction and a second offset distance from the load in a second direction.

6. The method of claim 5, wherein the first reefing and wrapping positions are separated by a first distance in the first direction and by a second distance in the second direction, the method further comprising moving the first reefing device at the stretch speed from the first reefing position to the first wrapping position by controlling a first-direction actuator to move the first reefing device in the first direction at a first lateral stretch speed and controlling the second-direction actuator to move the first reefing device in the second direction at a second lateral stretch speed.

7. The method of claim 6, wherein when the first and second distances are equal, the stretch speed is a designated stretch speed and the first and second lateral stretch speeds are the same designated lateral stretch speed.

8. The method of claim 7, wherein when the first and second distances are different, the first and second lateral stretch speeds are different and the stretch speed is different from the designated stretch speed.

9. The method of claim 8, wherein when the first distance is greater than the second distance, the first lateral stretch speed is the designated lateral stretch speed and the second lateral stretch speed is different from the designated lateral stretch speed.

10. The method of claim 9, wherein the designated lateral stretch speed is received via operator input.

11. The method of claim 9, wherein when the first distance is greater than the second distance, the second lateral stretch speed is lower than the designated lateral stretch speed.

12. The method of claim 9, further comprising determining the unwinding speed based on the designated stretch speed, the stretch speed, and a designated unwinding speed.

13. The method of claim 12, further comprising determining the designated stretch speed and the designated unwinding speed based on operator input.

14. The method of claim 13, further comprising determining the designated stretch speed based on the designated lateral stretch speed, which is received via operator input.

15. The method of claim 1, further comprising:

moving second, third, and fourth reefing devices to respective second, third, and fourth reefing positions;

reefing the segment of tubular film onto second, third, and fourth reefing fingers of the respective second, third, and fourth reefing devices;

after the segment of tubular film has been reefed onto the first, second, third, and fourth reefing fingers of the respective first, second, third, and fourth reefing devices, moving the second, third, and fourth reefing devices at the stretch speed from the second, third, and fourth reefing positions to the respective second, third, and fourth wrapping positions such that the second, third, and fourth reefing devices follow second, third, and fourth designated paths, respectively, such that the segment of tubular film is stretched; and driving second, third, and fourth drive rollers of the respective second, third, and fourth reefing devices at the unwinding speed in the unreefing direction while the second, third, and fourth reefing devices move from the second, third, and fourth reefing positions to the respective second, third, and fourth wrapping positions to unreef part of the segment of tubular film from the second, third, and fourth reefing fingers of the second, third, and fourth reefing devices.

16. The method of claim 15, wherein the first, second, third, and fourth designated paths each comprise different straight lines.

* * * * *